US008608157B2

(12) United States Patent
Fujikura et al.

(10) Patent No.: US 8,608,157 B2
(45) Date of Patent: Dec. 17, 2013

(54) MEDIUM FEED DEVICE AND IMAGE FORMING APPARATUS WITH SUCTION-MEMBER MOVING MECHANISM

(75) Inventors: Hiroaki Fujikura, Kanagawa (JP); Hiroatsu Kazama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 60 days.

(21) Appl. No.: 13/295,596

(22) Filed: Nov. 14, 2011

(65) Prior Publication Data

US 2013/0001862 A1 Jan. 3, 2013

(30) Foreign Application Priority Data

Jun. 28, 2011 (JP) ..... 2011-142457

(51) Int. Cl.
*B65H 7/02* (2006.01)
*B65H 3/08* (2006.01)

(52) U.S. Cl.
CPC ..... *B65H 3/0816* (2013.01)
USPC ..... 271/31; 271/30.1; 271/106

(58) Field of Classification Search
USPC ..... 271/30.1, 31, 103, 105, 106
See application file for complete search history.

(56) References Cited

U.S. PATENT DOCUMENTS 6,450,493 B1 * 9/2002 Milillo et al. ..... 271/105
2013/0020755 A1 * 1/2013 Kitazawa et al. ..... 271/108

FOREIGN PATENT DOCUMENTS

| | | |
|---|---|---|
| JP | A-2002-019978 | 1/2002 |
| JP | A-2005-194027 | 7/2005 |
| JP | A-2007-106567 | 4/2007 |
| JP | A-2008-094603 | 4/2008 |
| JP | A-2010-024057 | 2/2010 |
| JP | A-2010-143658 | 7/2010 |
| JP | A-2010-149982 | 7/2010 |

* cited by examiner

*Primary Examiner* — Gerald McClain
(74) *Attorney, Agent, or Firm* — Oliff & Berridge, PLC

(57) ABSTRACT

A medium feed device includes a suction member that sucks a medium on a stack member, a surrounding member supported movably in directions toward and away from the stack member together with the medium by suction, a stack-member moving mechanism, a suction-member moving mechanism, a transport member that transports the medium, a detected part associated with the surrounding member, a detecting part that is supported at the suction-member body and detects the detected part, a detector that detects a medium surface position based on a detection result of the detected part detected by the detecting part if the surrounding member moves toward the suction-member body from a state in which the medium contacts the surrounding member. The stack-member moving mechanism moves the stack member based on the medium surface position.

3 Claims, 23 Drawing Sheets

MEDIUM FEED DEVICE AND IMAGE FORMING APPARATUS WITH SUCTION-MEMBER MOVING MECHANISM

CROSS-REFERENCE TO RELATED APPLICATIONS

This application is based on and claims priority under 35 USC 119 from Japanese Patent Application No. 2011-142457 filed Jun. 28, 2011.

BACKGROUND

The present invention relates to a medium feed device and, an image forming apparatus.

SUMMARY

According to an aspect of the invention, there is provided a medium feed device including a stack member with a medium stacked thereon; a suction member including a suction-member body arranged to face the medium on the stack member, and a surrounding member that surrounds a suction port formed at the suction-member body, extends from the suction-member body toward the medium on the stack member, and is supported movably in directions toward and away from the stack member, the suction member having a space formed inside the surrounding member and surrounded by the surrounding member, a suction device being connected with the suction port, the suction device sucking gas from the space through the suction port and sucking the medium on the stack member, the surrounding member moving in the direction away from the stack member together with the medium by the suction of the suction device if the medium contacts a distal end of the surrounding member; a stack-member moving mechanism that moves the stack member between a sucked position at which the stack member moves toward the suction member and the medium on the stack member is sucked to the suction member and a retracted position at which the stack member is retracted in a direction away from the suction member with respect to the sucked position; a suction-member moving mechanism that moves the suction member between a suction position at which the suction member faces the medium on the stack member moved to the sucked position and is able to suck the medium and a feed position located downstream in a medium transport direction with respect to the suction position; a transport member that transports the medium sucked to the suction member moved to the feed position, to a downstream side; a detected part that is supported at the surrounding member and moves in association with movement of the distal end of the surrounding member; a detecting part that is supported in a stationary state relative to the suction-member body in the directions in which the surrounding member moves toward and away from the stack member and detects the detected part; and a detector that detects a medium surface position, which is a position of a surface of the medium that contacts the distal end of the surrounding member, with respect to the suction-member body, based on a detection result of the detected part detected by the detecting part if the stack member moves to the sucked position and when the stack member moves in the direction in which the distal end of the surrounding member moves toward the suction-member body from a state in which the medium on the stack member contacts the distal end of the surrounding member. The stack-member moving mechanism moves the stack member to the sucked position if the stack member moves to the sucked position and when the stack member moves in the direction in which the distal end of the surrounding member moves toward the suction-member body from the state in which the medium on the stack member contacts the distal end of the surrounding member, the stack-member moving mechanism moving the stack member to the sucked position based on the medium surface position detected by the detector.

BRIEF DESCRIPTION OF THE DRAWINGS

Exemplary embodiment(s) of the present invention will be described in detail based on the following figures, wherein:

FIGS. 5A and 58 are explanatory views of a suction head according to the first exemplary embodiment, FIG. 5A being a front view, FIG. 58 being a plan view;

FIGS. 8A and 88 are explanatory views of positions of the suction head according to the first exemplary embodiment, FIG. 8A being an explanatory view in a state in which the suction head moves to a suction position, FIG. 8B being an explanatory view in a state in which the suction head moves to a feed position;

DETAILED DESCRIPTION

Specific examples of exemplary embodiments of the present invention (hereinafter, referred to as exemplary embodiments) will be described below with reference to the accompanying drawings. However, the present invention is not limited to the exemplary embodiments.

For easier understanding of the following description, an X-axis direction represents a front-rear direction, a Y-axis direction represents a left-right direction, and a Z-axis direction represents an up-down direction. Sides indicated by arrows X, −X, Y, −Y, Z, and −Z respectively represent forward, rearward, rightward, leftward, upward, and downward, or a front side, a rear side, a right side, a left side, an upper side, and a lower side.

Also, a symbol in which a dot "•" is arranged in a circle "○" represents an arrow directed from the back side to the front side of the sheet of a drawing, and a symbol in which a cross "x" is arranged in a circle "○" represents an arrow directed from the front side to the back side of the sheet of a drawing.

In the following description with the drawings, illustration of parts other than parts required for easier understanding of the description is properly omitted.

First Exemplary Embodiment

Figure 1:
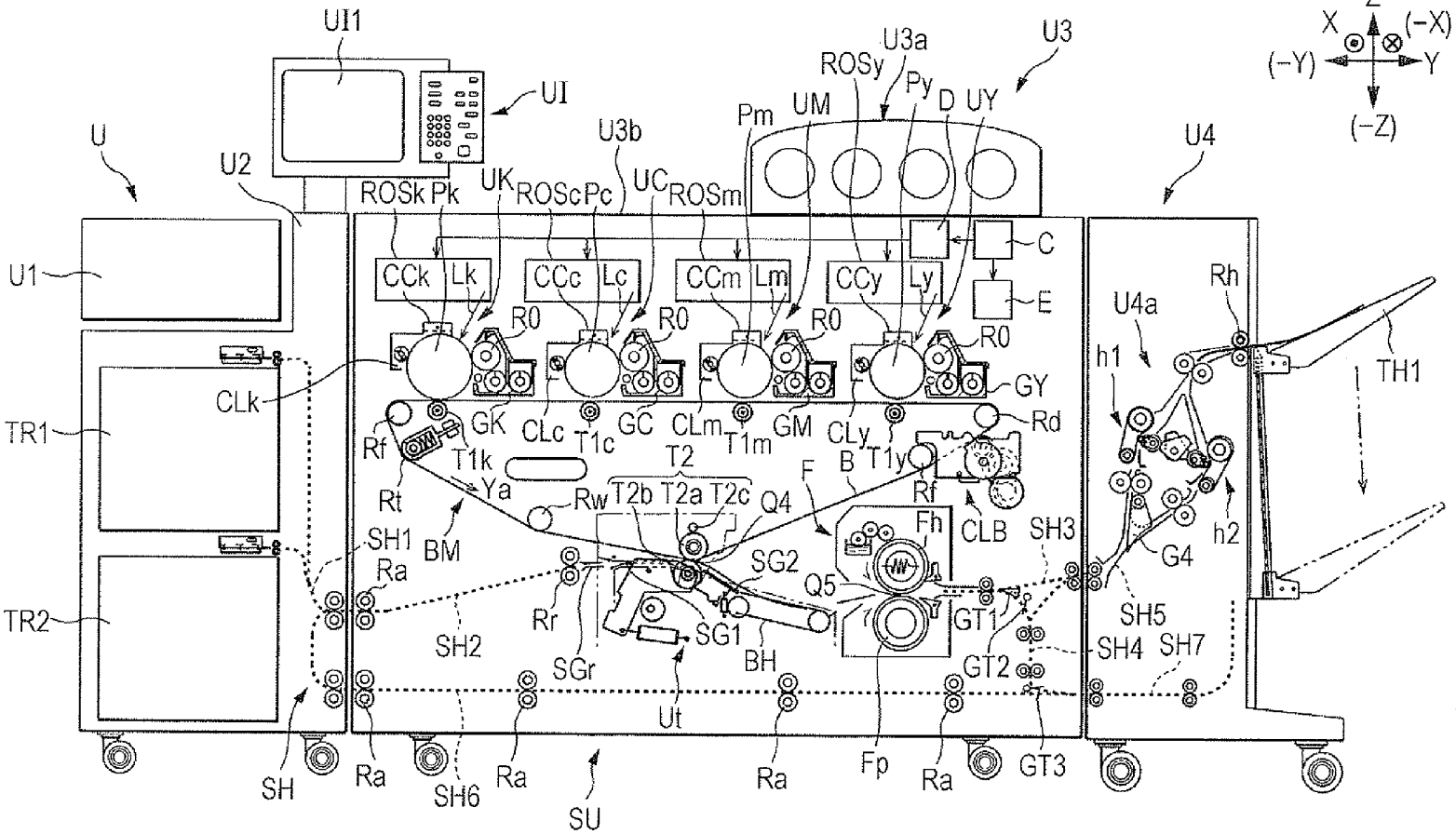
FIG. 1 is an explanatory overview of an image forming apparatus according to a first exemplary embodiment of the present invention.

FIG. 1 is an explanatory overview of an image forming apparatus according to a first exemplary embodiment of the present invention.

In FIG. 1, an image forming apparatus U includes a user interface UI as an example of an operation unit, an image scanner U1 as an example of an image-information input device, a sheet feed device U2 as an example of a medium feed device, an image-forming-apparatus body U3, and a sheet processing device U4.

The user interface UI includes input keys including a copy start key, a number-of-copies setting key, and a numeric keypad, as examples of an input unit; and a display unit UI1.

The image scanner U1 includes an automatic document feeder that automatically transports a document, and a scanner body as an example of an image reading device. In FIG. 1, the image scanner U1 reads a document (not shown), converts the read document into image information, and inputs the image information to the image-forming-apparatus body U3.

The sheet feed device U2 includes plural sheet feed trays TR1 and TR2 as examples of a sheet feed unit, and a sheet feed path SH1 as an example of a transport path through which a recording sheet S as an example of a medium sent from the sheet feed tray TR1 or TR2 is transported to the image-forming-apparatus body U3.

In FIG. 1, the image-forming-apparatus body U3 includes an image recording section that performs image recording on the recording sheet S transported from the sheet feed device U2, a toner dispenser device U3*a* as an example of a developer supply unit, a sheet transport path SH2, a sheet output path SH3, a sheet reverse path SH4, and a sheet circulation path SH6. The image recording section will be described later.

The image-forming-apparatus body U3 also includes a controller C, a laser drive circuit D as an example of a latent-image-writing drive circuit controlled by the controller C, and a power supply circuit E controlled by the controller C. The laser drive circuit D with its operation controlled by the controller C outputs laser driving signals input from the image scanner U1 and corresponding to image information of yellow (Y), magenta (M), cyan (C), and black (K) respectively to latent-image forming devices ROSy, ROSm, ROSc, and ROSk of these colors at predetermined timings.

In FIG. 1, a black image holding unit UK includes a photoconductor drum Pk as an example of an image holding body, a charger CCk, and a photoconductor cleaner CLk as an example of an image-holding-body cleaner. Image-holding-body units UY, UM, and UC of the other colors Y, M, and C also include photoconductor drums Py, Pm, and Pc, chargers CCy, CCm, and CCc as examples of a discharger, and photoconductor cleaners CLy, CLm, and CLc. In the first exemplary embodiment, the photoconductor drum Pk of K color, which is frequently used and a surface of which frequently wears, has a larger diameter than diameters of the photoconductor drums Py, Pm, and Pc of the other colors. Hence, the photoconductor drum Pk is rotatable at a high speed and has a long life.

The image-holding-body units UY, UM, UC, and UK and development units GY, GM, GC, and GK including development rollers R0 form toner-image forming members UY+GY, UM+GM, UC+GC, and UK+GK.

In FIG. 1, the photoconductor drums Py, Pm, Pc, and Pk are uniformly charged with electricity by the chargers CCy, CCm, CCc, and CCk, and then irradiated with laser beams Ly, Lm, Lc, and Lk as examples of latent-image writing light output from the latent-image forming devices ROSy, ROSm, ROSc, and ROSk. Thus, electrostatic latent images are formed on surfaces of the photoconductor drums Py, Pm, Pc, and Pk. The electrostatic latent images on the surfaces of the photoconductor drums Py, Pm, Pc, and Pk are developed into toner images as examples of a visible image with colors including Yellow (Y), magenta (M), cyan (C), and black (K) by the development rollers R0 as examples of a developer holding body of the development units GY, GM, GC, and GK.

The toner images on the surfaces of the photoconductor drums Py, Pm, Pc, and Pk are successively transferred in a superposed manner on an intermediate transfer belt B as an example of an intermediate transfer body by first transfer rollers T1*y*, T1*m*, T1*c*, and T1*k* as examples of a first transfer member. Thus, a multi-color image, i.e., a color image is formed on the intermediate transfer belt B. The color image formed on the intermediate transfer belt B is transported to a second transfer region Q4 as an example of an image recording region.

If only black image data is present, only the photoconductor drum Pk and the development unit GK of black (K) are used, and hence only a black toner image is formed.

After the first transfer, remaining toners on the surfaces of the photoconductor drums Py, Pm, Pc, and Pk are cleaned by the photoconductor cleaners CLy, CLm, CLc, and CLk.

A belt module BM as an example of an intermediate transfer device is arranged below the image-holding-body units UY to UK. The belt module BM includes the intermediate transfer belt B as the example of the intermediate transfer body, belt support rollers Rd, Rt, Rw, Rf, and T2*a* as examples of an intermediate-transfer-body support member, and the first transfer rollers T1*y*, T1*m*, T1*c*, and T1*k*. The belt support rollers Rd, Rt, Rw, Rf, and T2*a* include a belt driving roller Rd as an example of a driving member, a tension roller Rt as an example of a tension applying member, a working roller Rw as an example of an anti-meander member, plural idler rollers Rf as examples of a driven member, and a backup roller T2*a* as an example of a second-transfer facing member. The intermediate transfer belt B is supported by the belt support rollers Rd, Rt, Rw, Rf, and T2*a* rotatably in a direction indicated by arrow Ya.

A second transfer unit Ut is arranged below the backup roller T2*a*. A second transfer roller T2*b* as an example of a second transfer member of the second transfer unit Ut is arranged to be able to come into contact with and be separated from the backup roller T2*a* with the intermediate transfer belt B interposed therebetween. The second transfer region Q4 is formed in a region where the second transfer roller T2*b* is pressed to the intermediate transfer belt B. Also, a contact roller T2*c* as an example of a voltage-application contact member is in contact with the backup roller T2*a*. The rollers T2*a* to T2*c* form a second transfer member T2.

The power supply circuit E controlled by the controller C applies a second transfer voltage to the contact roller T2*c* at a predetermined timing. The second transfer voltage has a polarity that is the same as a charge polarity of the toner.

The sheet transport path SH2 is arranged below the belt module BM. The recording sheet S fed from the sheet feed path SH1 of the sheet feed device U2 is transported to the sheet transport path SH2 by transport rollers Ra as examples of plural medium transport members, and is sent to the second transfer region Q4 by registration rollers Rr as examples of a send-timing adjustment member, through a medium guide member SGr and a pre-transfer medium guide member SG1 in synchronization with a timing at which the toner image is transported to the second transfer region Q4. The toner image on the intermediate transfer belt B is transferred on the recording sheet S by the second transfer member T2 when the recording sheet S passes through the second transfer region Q4. In a case of a full-color image, the toner images successively first-transferred in a superposed manner on the surface of the intermediate transfer belt B are collectively second-transferred on the recording sheet S.

The intermediate transfer belt B after the second transfer is cleaned by a belt cleaner CLB as an example of an intermediate-transfer-body cleaner. The second transfer roller T2*b* is supported to be able to come into contact with and be separated from the intermediate transfer belt B.

The first transfer rollers T1*y*, T1*m*, T1*c*, and T1*k*, the intermediate transfer belt B, the second transfer member T2, the belt cleaner CLB, etc., form a transfer device T1+B+T2+CLB that transfer images on the surfaces of the photoconductor drums Py, Pm, Pc, and Pk onto a recording sheet S.

The photoconductor drums Py, Pm, Pc, and Pk, the development units GY, GM, GC, and GK, the transfer device T1+B+T2+CLB, etc., form a printer section U3*b* as an example of the image recording section according to the first exemplary embodiment.

The recording sheet S with the toner image second-transferred thereon is transported to a fixing device F through a post-transfer medium guide member SG2 and a sheet transport belt BH as an example of a pre-fixing medium transport member. The fixing device F includes a heat roller Fh as an example of a heat fixing member, and a pressure roller Fp as an example of a pressure fixing member. A region where the pressure roller Fp is pressed to the heat roller Fh forms a fixing region Q5.

When the recording sheet S passes through the fixing region Q5, the toner image on the recording sheet S is heated and fixed. A first gate GT1 as an example of a transport-path change member is provided downstream of the fixing device F. The first gate GT1 changes a path of the recording sheet S, which is transported through the sheet transport path SH2 and is heated and fixed in the fixing region Q5, selectively to the sheet output path SH3 or the sheet reverse path SH4 of the image-forming-apparatus body U3. The recording sheet S transported to the sheet output path SH3 is transported to a sheet transport path SH5 of the sheet processing device U4.

A curl correction device U4*a* as an example of a curve correction device is arranged in the middle of the sheet transport path SH5. A curl change gate G4 as an example of a transport-path change member is arranged in the sheet transport path SH5. The curl change gate G4 causes the recording sheet S transported from the sheet transport path SH3 of the image-forming-apparatus body U3 to be transported to a first curl correction member h1 or a second curl correction member h2 in accordance with a direction of a curve, i.e., a curl. When the recording sheet S is transported to the first curl correction member h1 or the second curl correction member h2, the curl of the recording sheet S is corrected. The recording sheet S with the curl corrected is output through output rollers Rh as examples of an output member onto an output tray TH1 as an example of an output part of the sheet processing device U4 in a state in which an image fixed surface of the recording sheet S faces upward, i.e., in a face-up state.

The recording sheet S transported toward the sheet reverse path SH4 of the image-forming-apparatus body U3 through the first gate GT1 pushes and passes through a second gate GT2 as an example of a transport-direction limit member formed of an elastic thin-film member, and is transported to the sheet reverse path SH4 of the image-forming-apparatus body U3.

The sheet circulation path SH6 and a sheet reverse path SH7 are connected to a downstream end of the sheet reverse path SH4 of the image-forming-apparatus body U3. A third gate GT3 as an example of a transport-direction limit member is arranged at the connection portion between the sheet circulation path SH6 and the sheet reverse path SH7. The recording sheet S transported to the sheet transport path SH4 through the first gate GT1 passes through the third gate GT3 and is transported toward the sheet reverse path SH7 of the sheet processing device U4. If duplex printing is performed, the recording sheet S transported through the sheet reverse path SH4 passes through the third gate GT3 once, is transported to the sheet reverse path SH7, and is transported in a reverse direction, i.e., is switched back. Then, the transport direction is limited by the third gate GT3. The switched back recording sheet S is transported toward the sheet circulation path SH6. The recording sheet S transported to the sheet circulation path SH6 passes through the sheet feed path SH1 and is sent again to the second transfer region Q4.

In contrast, if the recording sheet S transported through the sheet reverse path SH4 is switched back after a rear end in a medium transport direction of the recording sheet S passes through the second gate GT2 but before the rear end passes through the third gate GT3, the transport direction of the recording sheet S is limited by the second gate GT2. The recording sheet S is transported to the sheet transport path SH5 in a state in which the front side and the back side of the recording sheet S are reversed. The recording sheet S with the front side and the back side reversed is transported to the curl correction member U4*a* and a curl of the recording sheet S is corrected by the curl correction member U4*a*. Then, the recording sheet S is output onto the sheet output tray TH1 of the sheet processing device U4 in a state in which the image fixed surface of the recording sheet S faces downward, i.e., in a face-down state.

The elements indicated by reference signs SH1 to SH7 form a sheet transport path SH. Also, the elements indicated by reference signs SH, Ra, Rr, Rh, SGr, SG1, SG2, BH, GT1 to GT3, etc., form a medium transport system SU.

Description of Sheet Feed Trays TR1 and TR2

Figure 2:
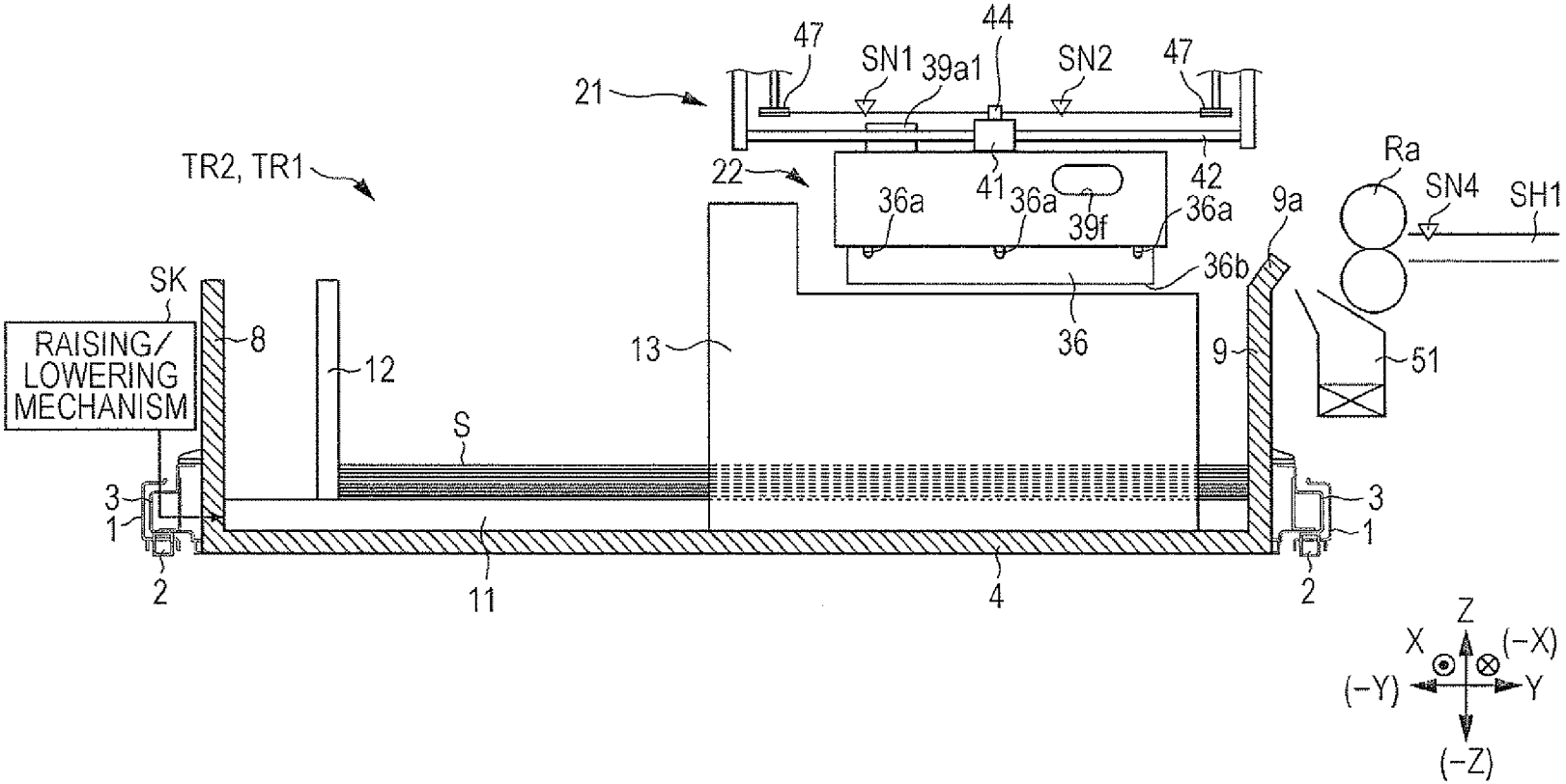
FIG. 2 is an explanatory view of a sheet feed tray according to the first exemplary embodiment.

FIG. 2 is an explanatory view of the sheet feed tray according to the first exemplary embodiment.

Here, only the second sheet feed tray TR2 of the sheet feed trays TR1 and TR2 according to the first exemplary embodiment is described in detail. Since the first sheet feed tray TR1 has a configuration similar to the second sheet feed tray TR2, detailed description of the first sheet feed tray TR1 is omitted.

In FIG. 2, rails 1 as examples of a guide member are respectively arranged outside both left and right ends of the second sheet feed tray TR2. The rails 1 extend in the front-rear direction. Rollers 2 as examples of a rotating member are respectively rotatably supported at positions below lower surfaces of the rails 1. Upper portions of the rollers 2 protrude to the upper sides of the rails 1 through holes formed in the lower surfaces of the rails 1.

Also, guided rails 3 are provided at lower portions at both left and right sides of the second sheet feed tray TR2. The guided rails 3 are examples of a guided member, protrude outward, extend in the front-rear direction, and are supported on upper surfaces of the rollers 2 at the lower surfaces of the rails 1. Hence, the second sheet feed tray TR2 is able to be pulled and inserted in the front-rear direction along the left and right rails 1. That is, the second sheet feed tray TR2 is movable between a pulled-out position at which the second sheet feed tray TR2 is pulled out from a body of the sheet feed device U2 and an inserted position at which the second sheet feed tray TR2 is inserted into the body of the sheet feed device U2.

Figure 3:
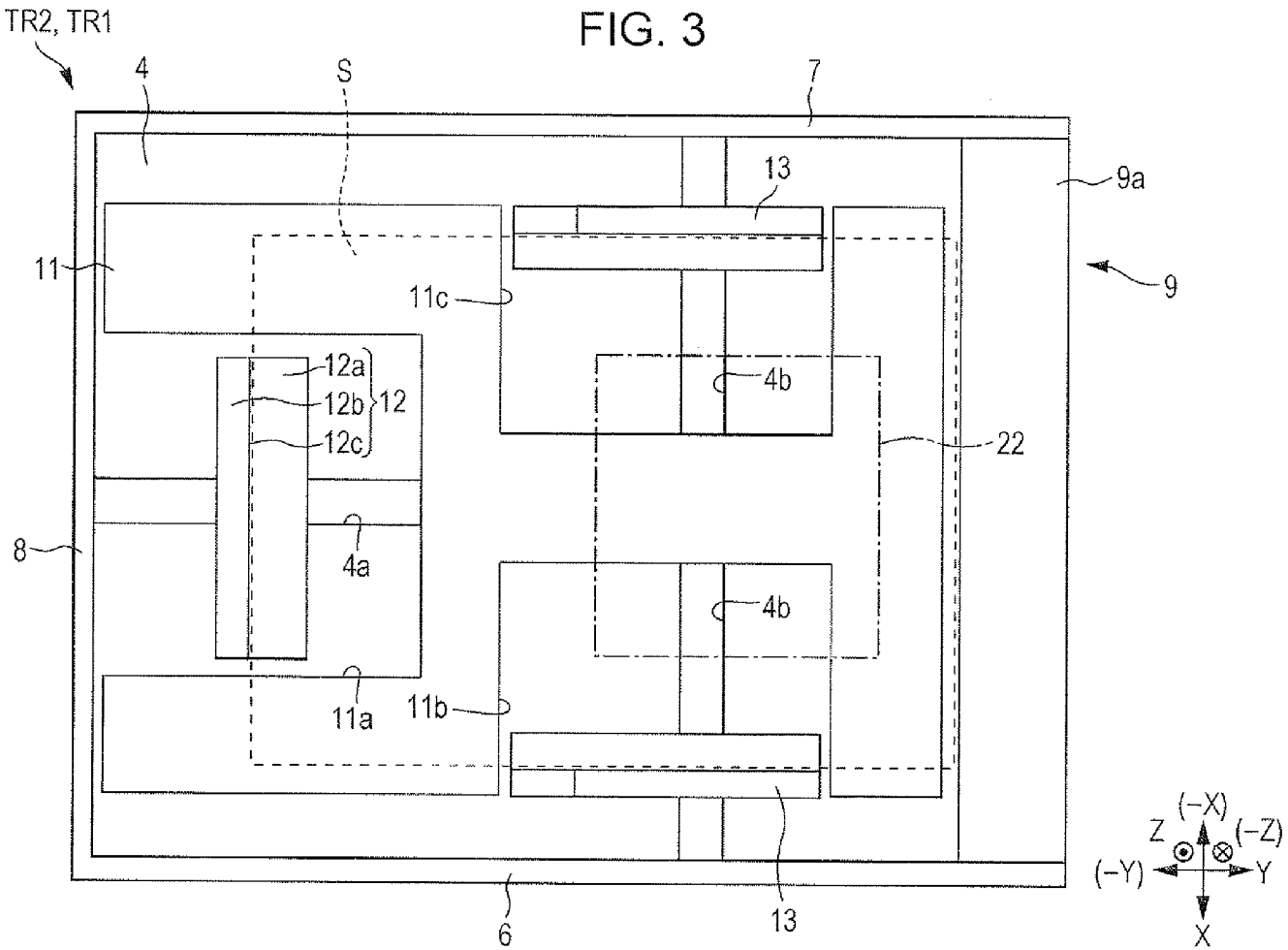
FIG. 3 is a plan view of the sheet feed tray according to the first exemplary embodiment.

FIG. 3 is a plan view of the sheet feed tray according to the first exemplary embodiment.

In FIGS. 2 and 3, the second sheet feed tray TR2 includes a bottom plate 4, and a front wall 6, a rear wall 7, a left wall 8, and a right wall 9 extending upward to surround the front, rear, left, and right sides of the bottom plate 4. In FIG. 3, a groove-like end guide groove 4*a* as an example of a first guide portion is formed in a left portion of the bottom plate 4 of the second sheet feed tray TR2. The groove-like end guide groove 4*a* extends in the left-right direction. Groove-like side guide grooves 4*b* as examples of a second guide portion are formed in a right portion of the bottom plate 4. The side guide grooves 4*b* extend in the front-rear direction. In FIG. 2, an inclination portion 9*a* is formed at an upper end portion of the right wall 9. The inclination portion 9*a* is inclined leftward as the inclination portion 9*a* extends upward. The inclination portion 9*a* guides the sent recording sheet S to the transport rollers Ra.

Figure 4A:
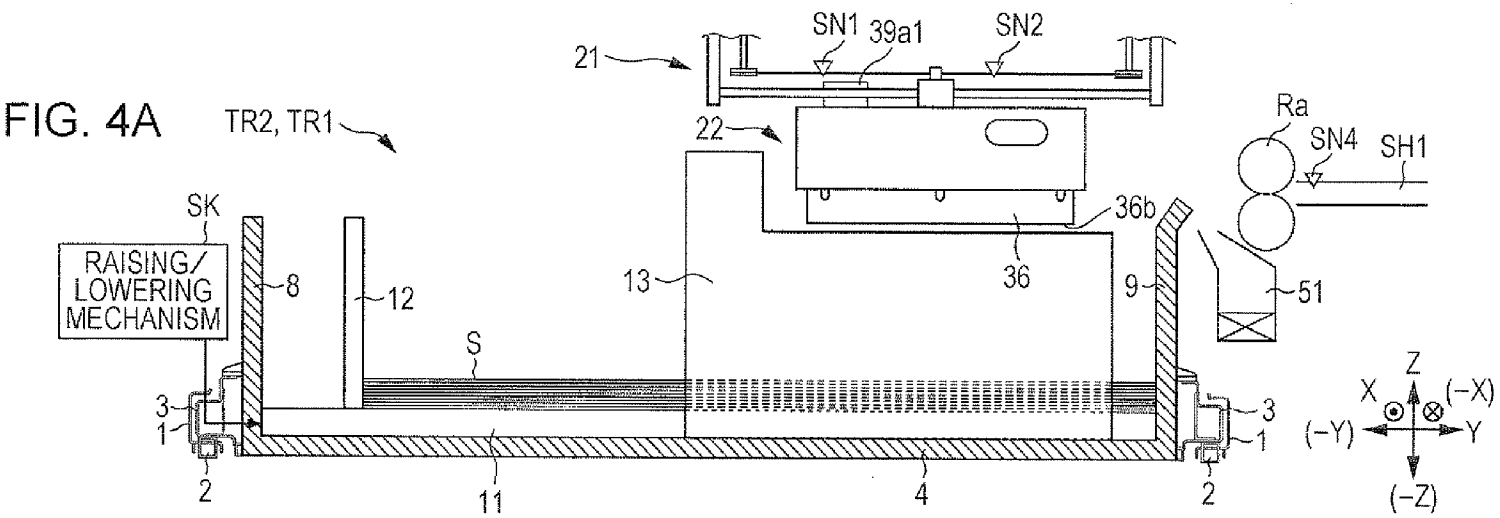
FIGS. 4A and 4B are explanatory views of positions of a stack plate according to the first exemplary embodiment, FIG. 4A being an explanatory view in a state in which the stack plate moves to a lowered position, FIG. 4B being an explanatory view in a state in which the stack plate moves to a raised position.
Figure 4B:
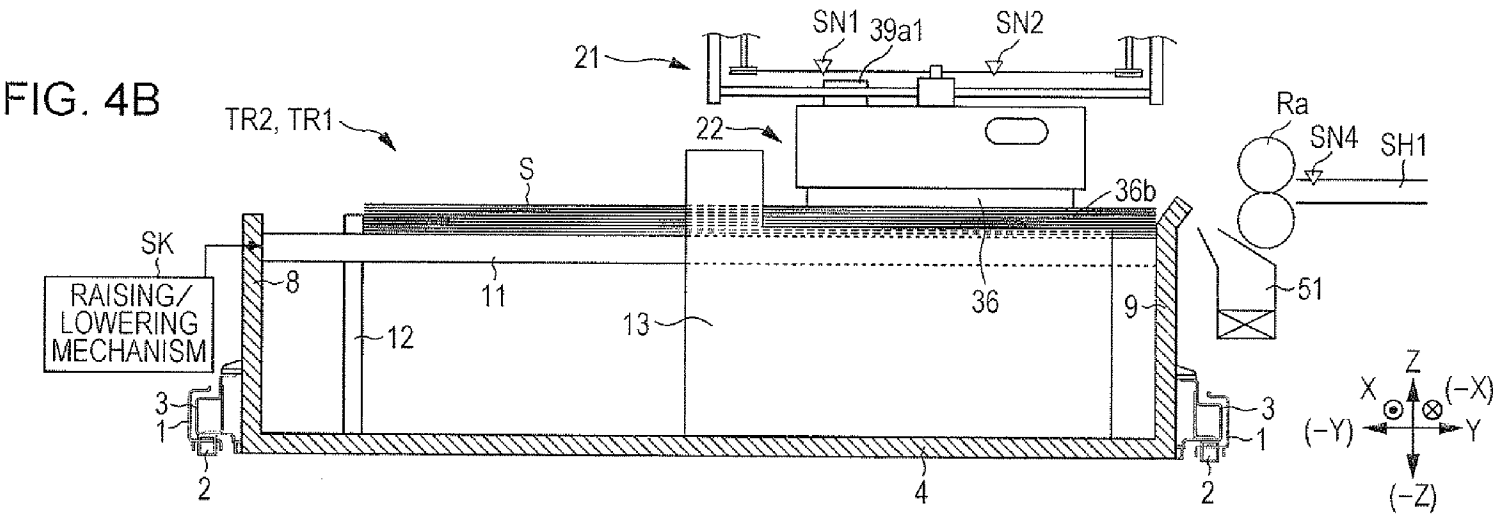

FIGS. 4A and 4B are explanatory views of positions of a stack plate according to the first exemplary embodiment, FIG. 4A being an explanatory view in a state in which the stack plate moves to a lowered position, FIG. 4B being an explanatory view in a state in which the stack plate moves to a raised position.

In FIGS. 2 to 4B, a flat-plate-like stack plate 11 as an example of a stack member is arranged on an upper surface of the bottom plate 4. Recording sheets S are stacked on the stack plate 11. The stack plate 11 has a left opening lie corresponding to the end guide groove 4*a* and extending from the left side toward a center portion, and a front opening 11*b* and a rear opening 11*c* corresponding to the side guide grooves 4*b* and extending from both front and rear ends toward the center portion. The stack plate 11 according to the first exemplary embodiment is able to be raised and lowered by a raising/lowering mechanism SK as an example of a stack-member moving mechanism by using a wire as an example of a linear member (not shown). That is, the stack plate 11 is able to be raised and lowered between a lowered position shown in FIG. 4A as an example of a retracted position at which the stack plate 11 is lowered and allows the recording sheets S to be stacked thereon, and a raised position shown in FIG. 42 as an example of a sucked position at which the stack plate 11 is raised to send the recording sheets S. The raising/lowering mechanism SK for the recording sheets S using the wire is known and, for example, disclosed in Japanese Unexamined Patent Application Publication No. 2010-143658 and No. 2010-149982. Since various configurations of related art may be employed, detailed description of the raising/lowering mechanism SK is omitted.

An end guide 12 as an example of a first alignment member is supported at the end guide groove 4*a* movably in the left-right direction along the end guide groove 4*a*. The end guide 12 includes a slide portion 12*a* as an example of a flat-plate-like alignment-member body extending along the bottom plate 4, and a contact portion 12*b* extending upward from a left end of the slide portion 12*a*. The end guide 12 has a substantially L-like shape when viewed from the front side. A contact surface 12*c* is formed at a right side surface of the contact portion 12*b*. The contact surface 12*c* is able to come into contact with left ends (edges) of the recording sheets S stacked on the stack plate 11. When the left ends of the recording sheets S contact the contact surface 12*c*, the left ends of a bundle of the recording sheets S are aligned.

A pair of side guides 13 as examples of a second alignment member are supported at the side guide grooves 4*b* movably in the front-rear direction along the side guide grooves 4*b*. The pair of side guides 13 are movable in association with each other in a direction in which the side guides 13 move toward and away from each other by a pinion gear as an example of a gear (not shown) and a rack having teeth. The configuration that the side guides move in association with each other in the direction in which the side guides move toward and away from each other by the pinion gear and the rack is described in, for example, Japanese Unexamined Patent Application Publication No. 2007-106567 and No. 2010-24057. Since various configurations of related art may be employed, detailed description is omitted.

Figure 5A:
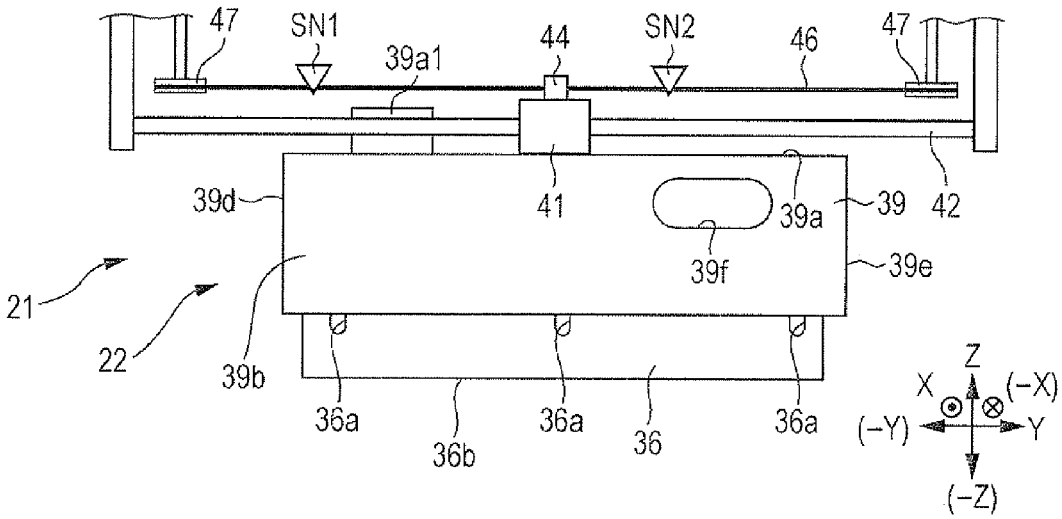
Figure 5B:
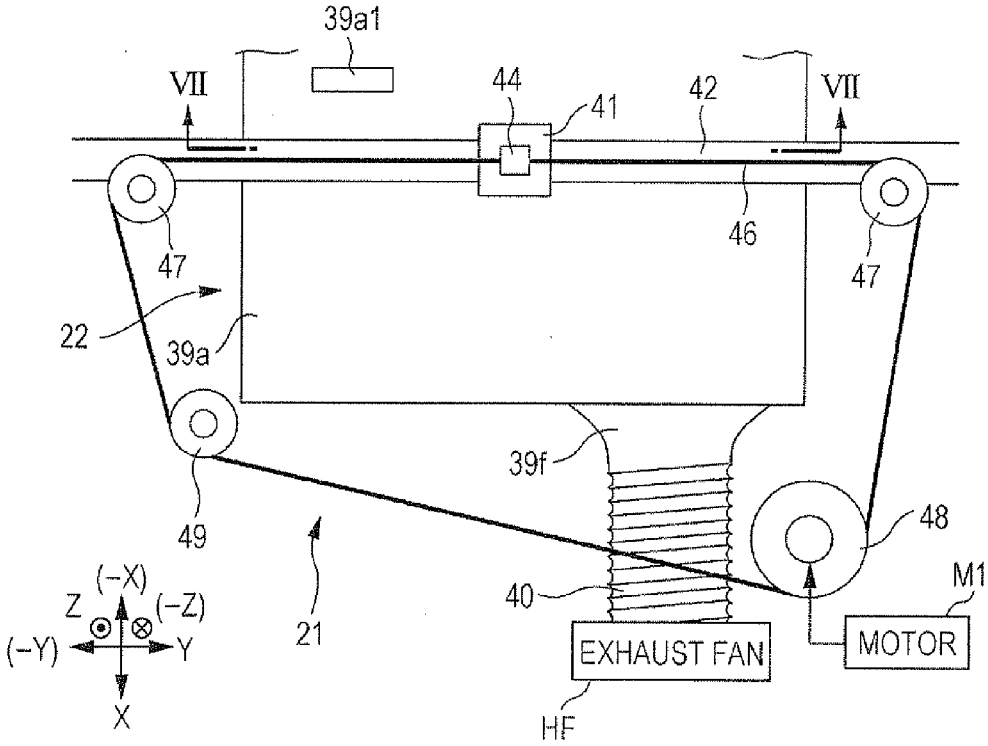

FIGS. 5A and 5B are explanatory views of a suction head according to the first exemplary embodiment, FIG. 5A being a front view, FIG. 5B being a plan view.

Figure 6:
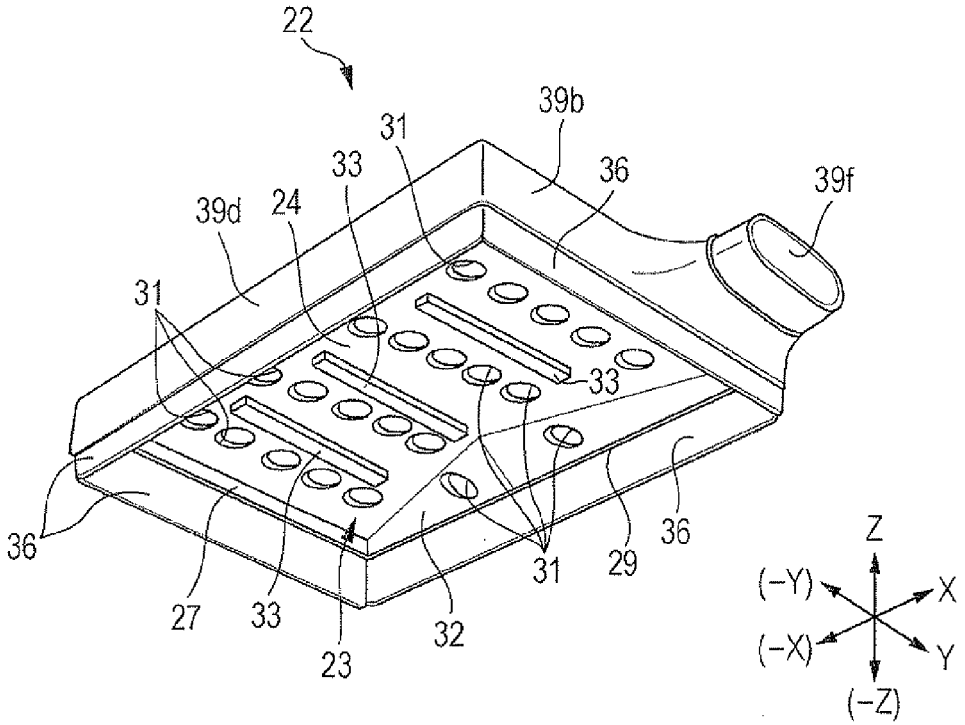
FIG. 6 is a perspective view of the suction head according to the first exemplary embodiment when viewed from the obliquely lower side.

FIG. 6 is a perspective view of the suction head according to the first exemplary embodiment when viewed from the obliquely lower side.

Figure 7:
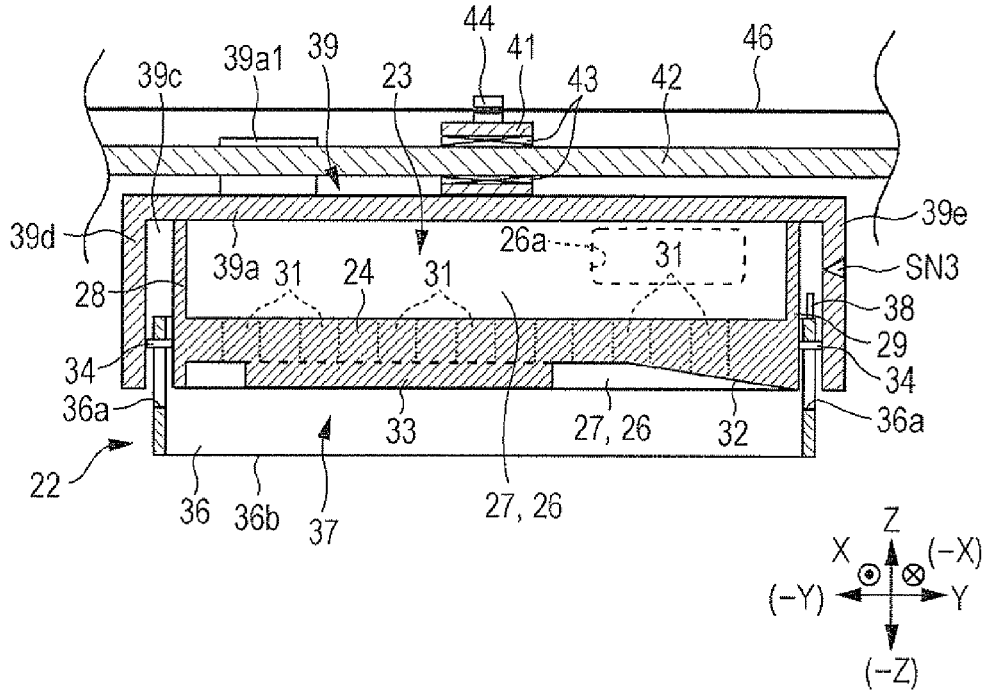
FIG. 7 is a cross-sectional view taken along line VII-VII in FIG. 5B.

FIG. 7 is a cross-sectional view taken along line VII-VII in FIG. 5B.

In FIGS. 2, and 4A to 7, a sheet taking device 21 as an example of a medium taking member is arranged above the second sheet feed tray TR2. The sheet taking device 21 includes a suction head 22 as an example of a suction member and also an example of a holding member. The suction head 22 is able to suck and hold a recording sheet S on the stack plate 11. The suction head 22 includes a box-like head body 23 as an example of a suction-member body and also an example of a holding-member body. The head body 23 includes a flat-plate-like bottom plate 24 and side walls 26, 27, 28, and 29 extending in the up-down direction from front, rear, left, and right sides of the bottom plate 24.

The bottom plate 24 has plural suction ports 31 penetrating through the bottom plate 24 in the up-down direction. An inclination surface 32 as an example of a curve applying portion is formed in a right portion of a lower surface of the bottom plate 24. The inclination surface 32 is inclined downward as the inclination surface 32 extends rightward and is inclined leftward as the inclination surface 32 extends to a center portion in the front-rear direction. Also, plural ribs 33 as examples of a curve applying portion are formed on the lower surface of the bottom plate 24. The ribs 33 each have a plate-like shape and extend in the left-right direction.

In FIGS. 5A and 7, plural pins 34 as examples of a surrounding support member are supported on outer surfaces of the side walls 26 to 29. The pins 34 protrude outward.

In FIGS. 5A, 6, and 7, a plate-like sealing skirt 36 as an example of a surrounding member is arranged at an outer surface of the head body 23. The sealing skirt 36 extends downward. The sealing skirt 36 has long holes 36*a* at positions corresponding to the pins 34. The long holes 36*a* extend in the up-down direction. The long holes 36*a* are supported in a state in which the pins 34 penetrate through the long holes 36*a*. Hence, the sealing skirt 36 according to the first exemplary embodiment is supported movably in the up-down direction, or in particular, in directions in which the sealing skirt 36 moves toward and away from the stack plate 11 or the recording sheet S stacked on the stack plate 11, with respect to the head body 23.

Hence, the suction ports 31 are arranged in an area surrounded by the sealing skirt 36 and the side walls 26 to 29. A space surrounded by the sealing skirt 36, the lower surface of the bottom plate 24, and the side walls 26 to 29 form a suction space 37 according to the first exemplary embodiment.

As shown in FIG. 7, a skirt light-shielding part 38 as an example of a detected part is supported at an upper right end portion of the sealing skirt 36. The skirt light-shielding part 38 extends upward and moves in association with movement of a distal end 36*b* of the sealing skirt 36. The skirt light-shielding part 38 according to the first exemplary embodiment moves together with the sealing skirt 36.

In FIGS. 5A to 7, a lid-like cover 39 as an example of a cover member is supported at an upper portion of the head body 23. The cover 39 includes a plate-like top plate 39*a* that closes the upper side of a space surrounded by the bottom plate 24 and the side walls 26 to 29, and side plates 39*b*, 39*c*, 39*d*, and 39*e* extending downward from the front, rear, left, and right sides of the top plate 39*a*. A head light-shielding part 39*a*1 is formed at a rear portion of an upper surface of the top plate 39*a*. The head light-shielding part 39*a*1 is an example of a suction-member-movement detected part and protrudes upward. The head light-shielding part 39*a*1 is detected by a suction-position sensor SN1 and a feed-position sensor SN2. The suction-position sensor SN1 is an example of a detecting member that detects a suction position of the suction member, and is supported at the body of the sheet feed device U2. The feed-position sensor SN2 is an example of a detecting member that detects a feed position of the suction member, and is supported at the body of the sheet feed device U2.

Also, a skirt sensor SN3 is supported at an inner surface of the right side plate 39*e*. The skirt sensor SN3 is an example of a detecting part and detects the skirt light-shielding part 38 that moves together with the sealing skirt 36. Hence, the skirt sensor SN3 according to the first exemplary embodiment is supported at the suction head 22. Regarding the entire suction head 22, the skirt sensor SN3 is supported movably along a guide shaft 42 (described later) and is supported in a stationary state relative to the head body 23 in the directions in which the sealing skirt 36 moves toward and away from the stack plate 11. That is, the skirt sensor SN3 is arranged at a position at which the skirt sensor SN3 is able to detect the skirt light-shielding part 38 in accordance with movement of the sealing skirt 36, in a state in which the suction head 22 faces the recording sheet S on the stack plate 11 and moves to the suction position at which the suction head 22 is able to suck the recording sheet S.

In FIGS. 5A to 7, an exhaust duct 39*f* as an example of a connection portion is formed at a right portion of the front side plate 39*b*. The exhaust duct 39*f* extends forward. One end of a bellows 40 as an example of a flexible member is connected with the exhaust duct 39*f*. The other end of the bellows 40 is connected with an exhaust fan HF as an example of a suction device.

Thus, the exhaust fan HF is connected with the suction ports 31 through an exhaust port 26*a* as an example of an opening formed in the front side wall 26, the exhaust duct 39*f*, and the bellows 40. When the exhaust fan HF is activated, gas and air in the suction space 37 are exhausted from the suction ports 31.

The members indicated by reference signs 23 to 39, etc., form the suction head 22 according to the first exemplary embodiment. Also, the suction head 22, the bellows 40, the exhaust fan HF, etc., form a sheet suction mechanism 22+40 as an example of a suction mechanism according to the first exemplary embodiment.

In FIGS. 5A, 5B, and 7, a shaft guide part 41 as an example of a guided part is supported at an upper surface of the cover 39. The shaft guide part 41 includes the guide shaft 42 as an example of a guide member. The guide shaft 42 is supported at the body of the sheet feed device U2, extends in the left-right direction that is the medium transport direction, and penetrates through the shaft guide part 41. The shaft guide part 41 according to the first exemplary embodiment is supported non-rotatably, but movably in the left-light direction along the guide shaft 42 through a linear ball bearing 43 as an example of a bearing member.

A wire fixing part 44 as an example of a coupling member is supported at an upper surface of the shaft guide part 41.

Figure 8A:
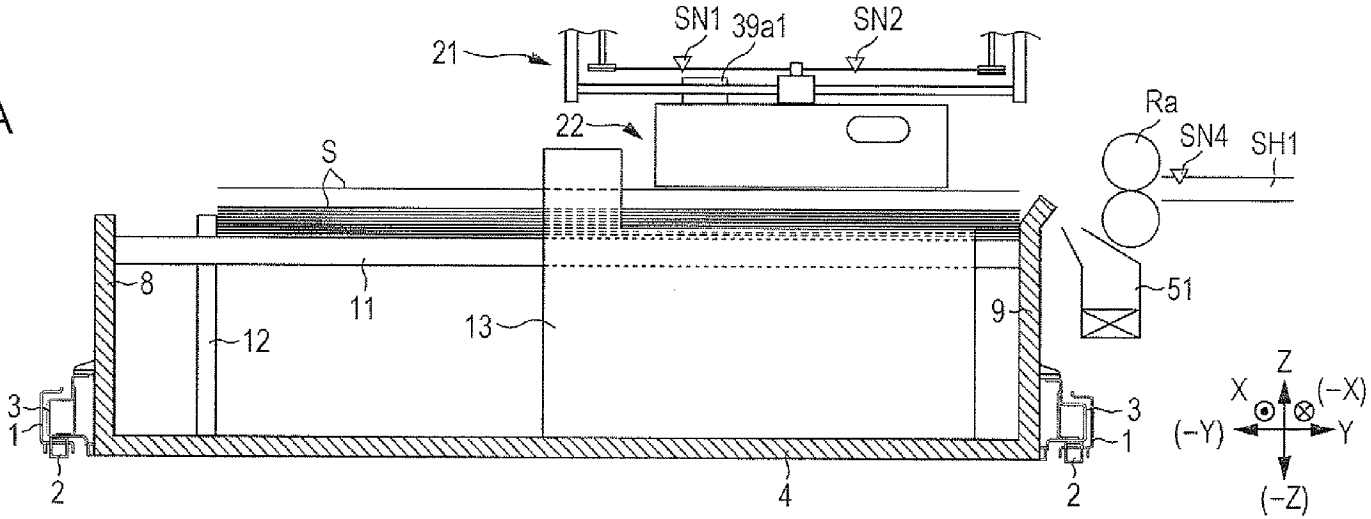
Figure 8B:
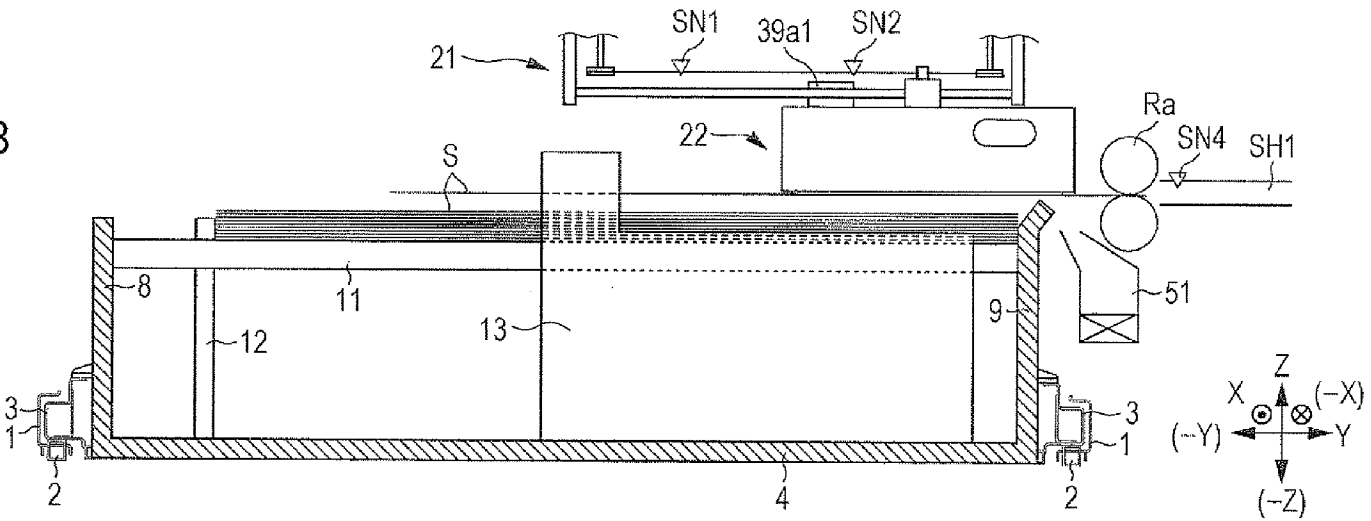

FIGS. 8A and 8B are explanatory views of positions of the suction head according to the first exemplary embodiment, FIG. 8A being an explanatory view in a state in which the suction head moves to a suction position, FIG. 8B being an explanatory view in a state in which the suction head moves to a feed position.

In FIGS. 5A, 5B, and 7, a wire 46 as an example of a linear member is fixed and supported at the wire fixing part 44. The wire 46 is supported by a pair of pulleys 47 arranged at the left and right sides of the wire fixing part 44, a driving pulley 48, and a driven pulley 49. The driving pulley 48 receives rotation transmitted from a motor M1 that is an example of a drive source and rotatable in forward and reverse directions. In FIG. 5B, the wire 46 rotates clockwise or counterclockwise in accordance with the rotation of the motor M1 in the forward or reverse direction, and hence the suction head 22 is movable in the left-right direction along the guide shaft 42.

Accordingly, the suction head 22 moves between the suction position shown in FIG. 8A at which the suction head 22 faces the recording sheet S on the stack plate 11 moved to the raised position and the suction head 22 is able to suck the recording sheet S, and the feed position shown in FIG. 8B at the downstream side in the transport direction of the recording sheet S with respect to the suction position. According to the first exemplary embodiment, the suction position is determined such that the suction-position sensor SN1 detects the head light-shielding part 39*a*1. When the suction-position sensor SN1 detects the head light-shielding part 39*a*1, it is determined that the suction head 22 is at the suction position. The feed position is determined such that the feed-position sensor SN2 detects the head light-shielding part 39*a*1. When the feed-position sensor SN2 detects the head light-shielding part 39*a*1, it is determined that the suction head 22 is at the feed position.

The wire 46, the pulleys 47 to 49, the motor M1, etc., form a head drive device 46-49+M1 according to the first exemplary embodiment as an example of a suction-member moving mechanism. Also, the sheet suction mechanism 22+40, the head drive device 46-49+M1, etc., form the sheet taking device 21 according to the first exemplary embodiment.

Description of Air Blowing Mechanism 51

In FIG. 2, an air blowing mechanism 51 as an example of a medium separating mechanism is provided in the body of the sheet feed device U2, at the right side of each of the sheet feed trays TR1 and TR2 inserted into the inserted position. The air blowing mechanism 51 blows the air as an example separating gas to a downstream end in the transport direction of the recording sheet S sucked to the suction head 22. If plural recording sheets S are sucked, the air blowing mechanism 51 blows the air to the recording sheets S and separates the recording sheets S from each other. The air blowing mechanism 51 is known, and a configuration described in, for example, Japanese Unexamined Patent Application Publication No 2005-194027 and No. 2008-94603 may be applied. Hence, detailed description is omitted.

Description of Sheet Feed Path SH1 and Transport Roller Ra

In FIGS. 2 and 8, the sheet feed path SH1 as an example of a medium feed path is formed at the right side of the suction head 22. The sheet feed path SH1 transports the recording sheet S fed by the suction head 22 moved to the feed position, to the image-forming-apparatus body U3. In the sheet feed path SH1, the transport rollers Ra are arranged at a position at which the transport rollers Ra are able to pinch a downstream end in the transport direction of the recording sheet S sucked to the suction head 22 when the suction head 22 sucks the recording sheet S and moves to the feed position. The transport rollers Ra transport the recording sheet S fed by the suction head 22 which is at the feed position, to the image-forming-apparatus body U3. A sheet sensor SN4 as an example of a medium detecting member is arranged downstream in the transport direction of the transport rollers Ra. The sheet sensor SN4 detects the recording sheet S provided from the suction head 22 to the transport rollers Ra.

The stack plate 11, the raising/lowering mechanism SK, the sheet taking device 21, the air blowing mechanism 51, the transport rollers Ra, the sheet feed path SH1, etc., form the sheet feed device U2 according to the first exemplary embodiment.

Description of Controller According to First Exemplary Embodiment

Figure 9:
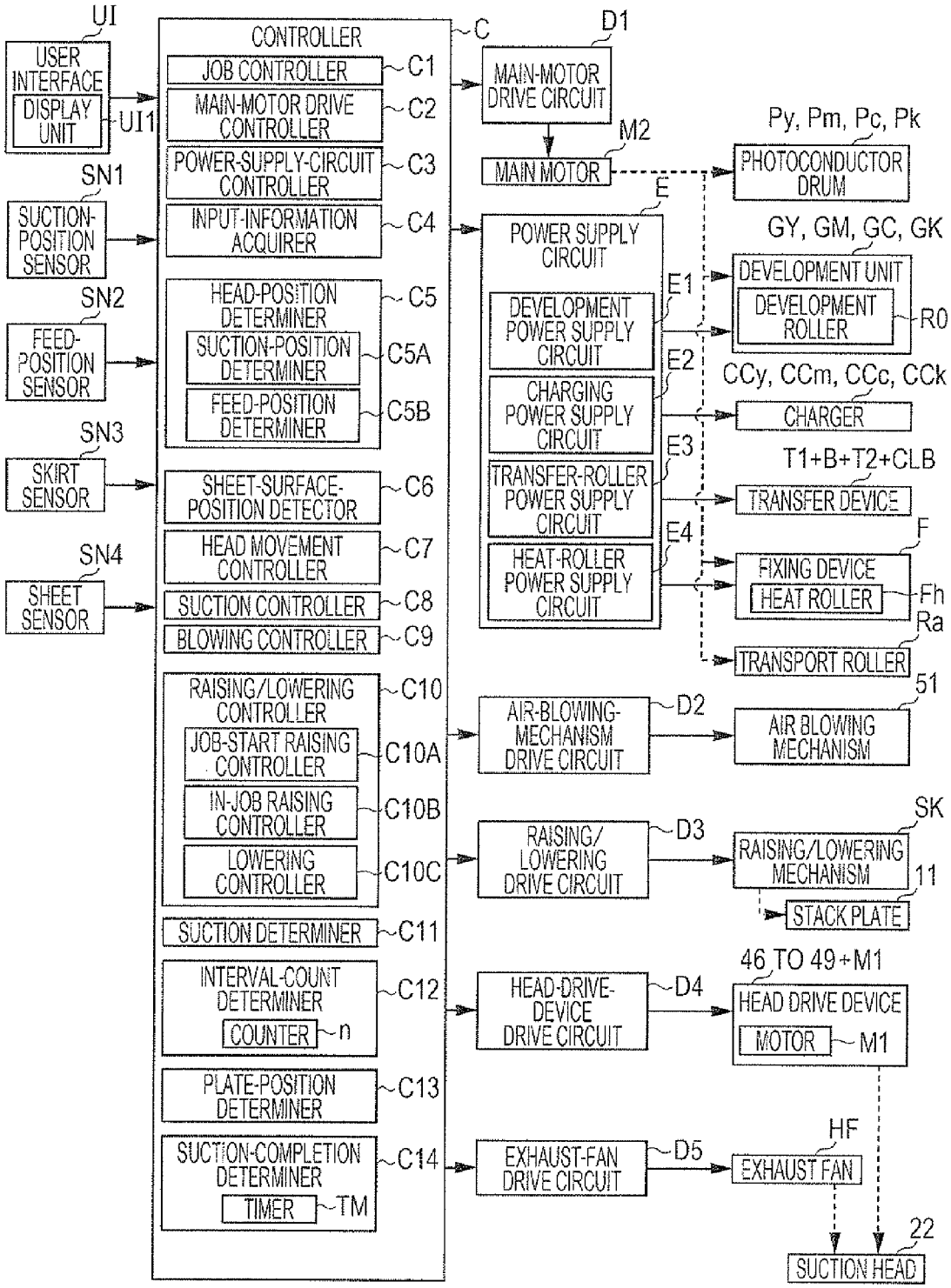
FIG. 9 is a block diagram showing functions included in a controller of the image forming apparatus according to the first exemplary embodiment.

FIG. 9 is a block diagram showing functions included in a controller of the image forming apparatus according to the first exemplary embodiment.

In FIG. 9, the controller C includes an input/output interface or I/O as an example of an input/output signal adjuster that executes input and output of signals to and from an external device and adjusts an input/output signal level; a read-only memory or ROM that stores programs, data, etc., for executing required processing; a random-access memory or RAM that temporarily stores required data; a central processing unit or CPU that executes processing in accordance with the programs stored in the ROM; and a computer as an example of a calculator having a clock oscillator. The controller C is able to realize various functions by executing the programs stored in the ROM.

Signal Output Element Connected with Controller C

The controller C receives output signals of the signal output elements UI, and SN1 to SN4.

User Interface UI

The user interface UI includes the input keys including the copy start key, the number-of-copies setting key, and the numeric keypad; and the display unit UI1. The user interface UI detects input of the copy start key, the number-of-copies setting key, and the numeric keypad and inputs detection signals to the controller C.

Suction-Position Sensor SN1

The suction-position sensor SN1 is formed of an optical sensor including a light-emitting section and a light-receiving section. The suction-position sensor SN1 detects the presence of the head light-shielding part 39*a*1 that is inserted between the light-emitting section and the light-receiving section, and inputs a detection signal to the controller C.

Feed-Position Sensor SN2

The feed-position sensor SN2 is formed of an optical sensor including a light-emitting section and a light-receiving section. The feed-position sensor SN2 detects the presence of the head light-shielding part 39*a*1 that is inserted between the light-emitting section and the light-receiving section, and inputs a detection signal to the controller C.

Skirt Sensor SN3

The skirt sensor SN3 is formed of an optical sensor including a light-emitting section and a light-receiving section. The skirt sensor SN3 detects the presence of the skirt light-shielding part 38 that is inserted between the light-emitting section and the light-receiving section, and inputs a detection signal to the controller C.

Sheet Sensor SN4

The sheet sensor SN4 is formed of an optical sensor including a light-emitting section and a light-receiving section. The sheet sensor SN4 detects the presence of a recording sheet S that is inserted between the light-emitting section and the light-receiving section, and inputs a detection signal to the controller C.

Controlled Element Connected with Controller C

The controller C outputs control signals for controlled elements D1 to D5, and E.

Main-Motor Drive Circuit D1

A main-motor drive circuit D1 as an example of a main-drive-source drive circuit drives a main motor M2 as an example of a main drive source. Accordingly, the main-motor drive circuit D1 rotationally drives the photoconductor drums Py, Pm, Pc, and Pk, the development rollers R0 of the development units GY, GM, GC, and GK, the heat roller Fh of the fixing device F, the transport rollers Ra, etc., through gears (not shown) as examples of a drive force transmitting member.

Air-Blowing-Mechanism Drive Circuit D2

An air-blowing-mechanism drive circuit D2 as an example of a medium-separating-mechanism drive circuit drives the air blowing mechanism 51 so as to blow the air to the recording sheet S sucked to the suction head 22.

Raising/Lowering Drive Circuit D3

A raising/lowering drive circuit D3 as an example of a stack-member-moving-mechanism drive circuit drives the raising/lowering mechanism SK so as to raise and lower the stack plate 11.

Head-Drive-Device Drive Circuit D4

A head-drive-device drive circuit D4 as an example of a suction-member-moving-mechanism drive circuit drives the motor M1 to drive the head drive device 46-49+M1, so that the head drive device 46-49+M1 moves the suction head 22.

Exhaust-Fan Drive Circuit D5

An exhaust-fan drive circuit D5 as an example of a suction-device drive circuit drives the exhaust fan HF so as to exhaust gas from the suction space 37 in the suction head 22.

Power Supply Circuit E

The power supply circuit E includes a development power supply circuit E1, a charging power supply circuit E2, a transfer-roller power supply circuit E3, and a heat-roller power supply circuit E4.

Development Power Supply Circuit E1

The development power supply circuit E1 applies a development voltage to the development rollers R0 of the development units GY, GM, GC, and GK.

Charging Power Supply Circuit E2

The charging power supply circuit E2 applies a charge voltage to the chargers CCy, CCm, CCc, and CCk.

Transfer-Roller Power Supply Circuit E3

The transfer-roller power supply circuit E3 applies a transfer voltage to the first transfer rollers T1*y*, T1*m*, T1*c*, and T1*k*, and the contact roller T2*c* of the transfer device (T1+B+T2+CLB).

Heat-Roller Power Supply Circuit E4

The heat-roller power supply circuit E4 applies electric power for heating to a heater as an example of a heat member of the heat roller Fh of the fixing device F.

Functions of Controller C

The controller C includes function realizing units as follows through programs for controlling operations of the controlled elements D1 to D5, and E in accordance with output signals of the signal output elements U1, and SN1 to SN4.

Job Controller C1

A job controller C1 as an example of an image-forming-operation controller controls operations of the latent-image forming devices ROSy, ROSm, ROSc, and ROSk of the respective colors, the chargers CCy, CCm, CCc, and CCk, the image recording section G3*b*, the fixing device F, the sheet transport device SU, etc., in response to input of the copy start key, and executes a job as an example of an image forming operation.

Main-Motor Drive Controller C2

A main-motor drive controller C2 as an example of a main-drive-source drive controller controls rotation of the main motor M2 through the main-motor drive circuit D1 and controls rotational driving of the photoconductor drums Py, Pm, Pc, and Pk, the development rollers R0 of the development units GY, GM, GC, and GK, the heat roller Fh of the fixing device F, the transport rollers Ra, etc.

Power-Supply-Circuit Controller C3

A power-supply-circuit controller C3 controls an operation of the power supply circuit E, and controls feed of voltage and current to the development rollers R0, the chargers CCy, CCm, CCc, and CCk, the first transfer rollers T1*y*, T1*m*, T1*c*, and T1*k*, the contact roller T2*c*, the heater of the heat roller Fh of the fixing device F, etc.

Input-Information Acquirer C4

An input-information acquirer C4 acquires the number of copies as an example of the number of recording sheets, based on input information of the number-of-copies setting key of the user interface UI.

Head-Position Determiner C5

A head-position determiner C5 as an example of a suction-member-position detector includes a suction-position determiner C5A and a feed-position determiner C58, and determines whether the suction head 22 moves to the suction position or the feed position.

Suction-Position Determiner C5A

The suction-position determiner C5A determines whether the suction head 22 is at the suction position or not, based on a detection result of the suction-position sensor SN1. The suction-position determiner C5A according to the first exemplary embodiment determines that the suction head 22 is at the suction position if a detection signal indicative of that the suction-position sensor SN1 detects the head light-shielding part 39*a*1 is transmitted from the suction-position sensor SN1.

Feed-Position Determiner C5B

The feed-position determiner C5B determines whether the suction head 22 is at the feed position or not, based on a detection result of the feed-position sensor SN2. The feed-position determiner C5B according to the first exemplary embodiment determines that the suction head 22 is at the feed position if a detection signal indicative of that the feed-position sensor SN2 detects the head light-shielding part 39*a*1 is transmitted from the feed-position sensor SN2.

Figure 10A:
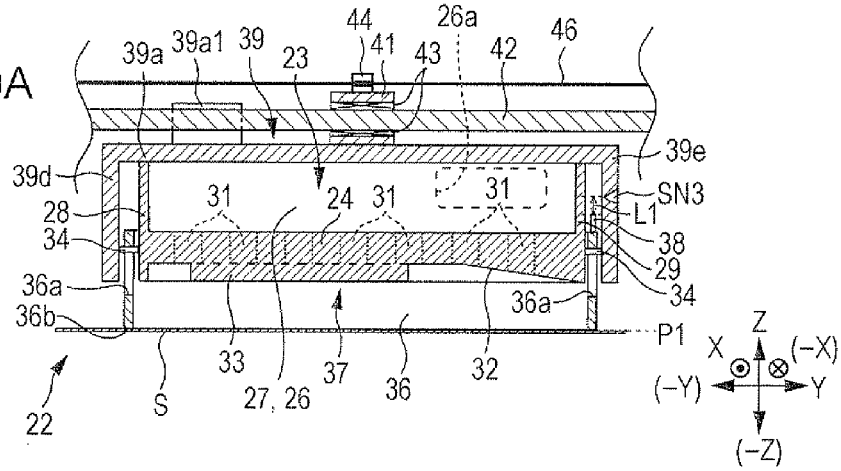
FIGS. 10A to 10C are explanatory views of movement of a sealing skirt according to the first exemplary embodiment and correspond to FIG. 7, FIG. 10A being an explanatory view in a state in which the sealing skirt moves to a lower-limit position, FIG. 10B being an explanatory view in a state in which the sealing skirt is raised from the state in FIG. 10A to a detected position, FIG. 10C being an explanatory view in a state in which the sealing skirt is raised from the state in FIG. 10B to an upper-limit position.
Figure 10B:
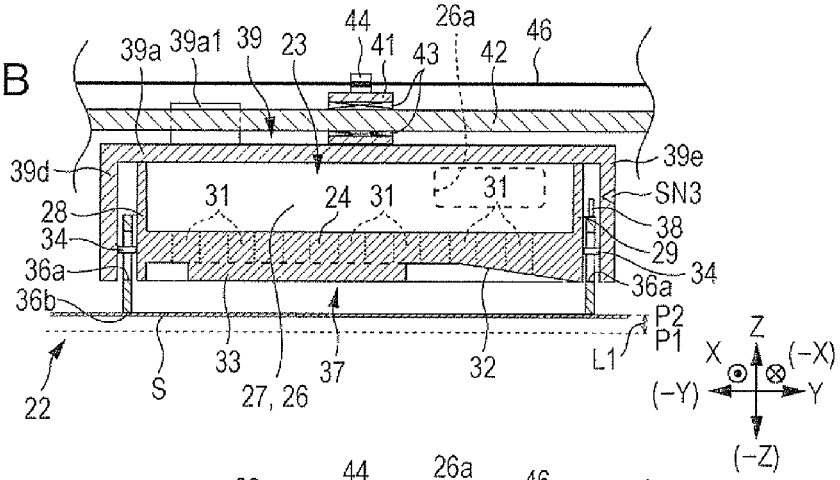
Figure 10C:
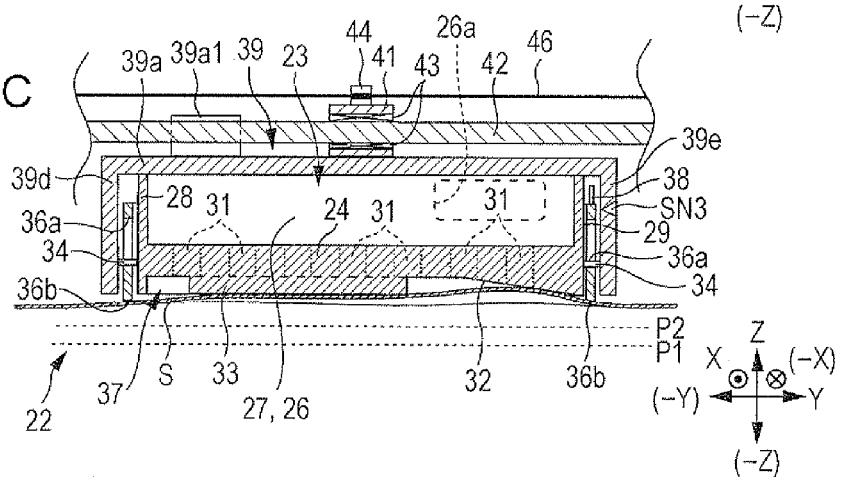

FIGS. 10A to 10C are explanatory views of movement of a sealing skirt according to the first exemplary embodiment and correspond to FIG. 7, FIG. 10A being an explanatory view in a state in which the sealing skirt moves to a lower-limit position, FIG. 10B being an explanatory view in a state in which the sealing skirt is raised from the state in FIG. 10A to a detected position, FIG. 10C being an explanatory view in a state in which the sealing skirt is raised from the state in FIG. 10B to an upper-limit position.

Sheet-Surface-Position Detector C6

A sheet-surface-position detector C6 as an example of a medium-surface-position detector detects a sheet surface position as an example of a medium surface position that is a position of a surface of a recording sheet S with respect to the head body 23 and that is a position of a surface of a recording sheet S when the recording sheet S contacts the distal end 36*b* of the sealing skirt 36, based on a detection result of the skirt light-shielding part 38 detected by the skirt sensor SN3. According to the first exemplary embodiment, the length of the skirt light-shielding part 38 is determined such that the skirt light-shielding part 38 is inserted into the area between the light-emitting section and the light-receiving section of the skirt sensor SN3 at the detected position shown in FIG. 10B at which the sealing skirt 36 is raised by a predetermined distance L1 with respect to the lower-limit position shown in FIG. 10A at which upper ends of the long holes 36*a* of the sealing skirt 36 contact the pins 34.

Hence, in the first exemplary embodiment, if the skirt sensor SN3 detects the skirt light-shielding part 38, the distal end 36*b* of the sealing skirt 36 is raised from the lower-limit position by the predetermined distance L1. Accordingly, if the sealing skirt 36 is raised while the recording sheet S contacts the distal end 36*b* of the sealing skirt 36 and a detection signal indicative of that the skirt sensor SN2 detects the skirt light-shielding part 38 is transmitted from the skirt sensor SN2, the sheet-surface-position detector C6 according to the first exemplary embodiment determines that the sheet surface position moves from a position P1 corresponding to the lower-limit position to a position P2 that is close to the head body 23 with respect to the position P1 by the distance L1.

Head Movement Controller C7

A head movement controller C7 as an example of a suction-member-moving-mechanism controller controls driving of the head drive device 46-49+M1 through the head-drive-device drive circuit D4 so as to move the suction head 22 between the suction position shown in FIG. 8A and the feed position shown in FIG. 8B. If the suction head 22 sucks the recording sheet S, the head movement controller C7 according to the first exemplary embodiment moves the suction head 22 rightward until the feed-position determiner C5B determines that the suction head 22 moves from the suction position to the feed position. Also, if it is determined that the suction head 22 is at the feed position, the head movement controller C7 moves the suction head 22 leftward until the suction-position determiner C5A determines that the suction head 22 moves from the feed position to the suction position. Accordingly, the suction head 22 moves from the suction position to the feed position, and then returns from the feed position to the suction position. When a job is started by initialization as an example of initialization control, if the suction-position determiner C5A does not determine that the suction head 22 is at the suction position, i.e., if the suction-position sensor SN1 does not detect the head light-shielding part 39*a*1, the head movement controller C7 according to the first exemplary embodiment moves the suction head 22 leftward to the suction position.

Suction Controller C8

A suction controller C8 as an example of a suction-device controller controls driving of the exhaust fan HF through the exhaust-fan drive circuit D5 so as to control suction of the recording sheet S to the suction head 22. The suction controller C8 according to the first exemplary embodiment causes the exhaust fan HF to exhaust the gas from the suction space 37 in the suction head 22 and the suction head 22 to suck the recording sheet S on the stack plate 11 by a flow of the air as the result of the exhaustion and a negative pressure of the suction space 37 lower than the atmospheric pressure. If a job is executed and the recording sheet S is fed from the sheet feed device U2 to the image-forming-apparatus body U3, if the stack plate 11 is present at the raised position, and if the suction head 22 is present at the suction position, the suction controller C8 according to the first exemplary embodiment drives the exhaust fan HF, so that the suction head 22 sucks the recording sheet S. Then, if the suction head 22 reaches the feed position, the suction controller C8 stops driving of the exhaust fan HF.

If the recording sheet S is sucked to the suction head 22, the recording sheet S contacts and is sucked to the distal end 36*b* of the sealing skirt 36, and the sealing skirt 36 is raised together with the recording sheet S as the result of exhaustion and suction by the exhaust fan HF in the direction away from the stack plate 11 to the upper-limit position shown in FIG. 10C. If the sealing skirt 36 is at the upper-limit position and the exhaust fan HF further performs exhaustion, the sucked recording sheet S contacts the inclination surface 32 and the ribs 33 shown in FIGS. 6, 10A to 10C, etc., formed at the bottom plate 24 of the head body 23. Accordingly, if a top recording sheet S and a next recording sheet S are sucked due to for example, static electricity, since the top recording sheet S becomes cackled because of the inclination surface 32, the ribs 33, etc., a gap is generated between the top recording sheet S and the next recording sheet S, and the adhering recording sheet S easily falls.

Blowing Controller C9

A blowing controller C9 as an example of a medium-separating-mechanism controller controls driving of the air blowing mechanism 51 through the air-blowing-mechanism drive circuit D2 so as to blow the air to the recording sheet S sucked to the suction head 22. The blowing controller C9 according to the first exemplary embodiment causes the air blowing mechanism 51 to blow the air while the suction head 22 moves from the suction position to the feed position. Thus, the air blowing mechanism 51 blows the air to the downstream end in the transport direction of the recording sheet S sucked to the suction head 22. Accordingly, if plural recording sheets S are sucked to the suction head 22, the air flows into the gap between the top recording sheet S and the next recording sheet S, the next recording sheet S is separated, and the recording sheets S except the top recording sheet S fall. Thus, the recording sheets S are separated from each other by air-blowing. When the recording sheets S are separated, the separated recording sheets S fall on and return to the stack plate 11.

Raising/Lowering Controller C10

A raising/lowering controller C10 as an example of a stack-member-moving-mechanism controller includes a job-start raising controller C10A, an in-job raising controller C10B, and a lowering controller C10C. The raising/lowering controller C10 controls driving of the raising/lowering mechanism SK through the raising/lowering drive circuit D3 so as to raise and lower the stack plate 11 between the raised position shown in FIG. 4B at which the stack plate 11 moves toward the suction head 22 and the recording sheet S on the stack plate 11 is sucked to the suction head 22 and the lowered position shown in FIG. 4A at which the stack plate 11 is retracted to the lower side in the direction away from the suction head 22 with respect to the raised position.

Job-Start Raising Controller C10A

If a start first recording sheet S is fed at start of a job, the job-start raising controller C10A moves the stack plate 11 to the raised position, based on a detection result of the sheet-surface-position detector C6. Before a first recording sheet S at start of the job is fed, if the suction-position determiner C5A determines that the suction head 22 is at the suction position, the job-start raising controller C10A according to the first exemplary embodiment raises the stack plate 11 from the lowered position, so that, as shown in FIG. 10A, the recording sheet S on the stack plate 11 contacts the distal end 36*b* of the sealing skirt 36 at the lower-limit position. Then, the job-start raising controller C10A according to the first exemplary embodiment moves the stack plate 11 from the state in which the recording sheet S on the stack plate 11 contacts the distal end 36*b* of the sealing skirt 36 at the lower-limit position to the upper side in the direction in which the distal end 36*b* of the sealing skirt 36 moves toward the head body 23, and raises the stack plate 11 until the sheet surface position of the recording sheet S on the stack plate 11 moves from the position P1 corresponding to the lower-limit position to the position P2 that is close to the head body 23 with respect to the position P1 by the distance L1 as shown in FIG. 10B. That is, the job-start raising controller C10A according to the first exemplary embodiment continuously raises the stack plate 11 from the lowered position until the sheet-surface-position detector C6 detects that the sheet surface position is raised from the position P1 by the distance L1, so that the stack plate 11 moves to the raised position.

In-Job Raising Controller C10B

When the job is executed, recording sheets S stacked on the stack plate 11 are reduced, and a topmost surface of the recording sheets S is lowered, the in-job raising controller C10B performs control to move the stack plate 11 to the raised position, based on a detection result of the sheet-surface-position detector C6. The in-job raising controller C10B according to the first exemplary embodiment performs control to move the stack plate 11 to the raised position, based on a detection result of the sheet-surface-position detector C6 every time when the recording sheets S are fed by a predetermined number m. That is, every time when the recording sheets S are fed by the predetermined number m, if the suction-position determiner C5A determines that the suction head 22 is at the suction position before a next recording sheet S is fed, the in-job raising controller C10B according to the first exemplary embodiment raises and moves the stack plate 11 to the raised position until the sheet-surface-position detector C6 detects that the sheet surface position is raised from the lower-limit position by the distance L1, so that the stack plate 11 moves to the raised position.

Lowering Controller C10C

The lowering controller C10C lowers the stack plate 11 to the lowered position when the job is ended.

Suction Determiner C11

A suction determiner C11 as an example of a suction-device drive determiner determines whether the exhaust fan HF is driven or not, based on a control signal of the suction controller C8.

Interval-Count Determiner C12

An interval-count determiner C12 includes a counter n as an example of a number-of-sheets counter that counts the number of recording sheets S to be fed, and determines whether a value of the counter n is the predetermined number m or not. According to the first exemplary embodiment, if the value of the counter n is the number m, the interval-count determiner C12 determines that the stack plate 11 is being raised and initializes the value of the counter n to 0. Thus, the value of the counter n is reset.

Plate-Position Determiner C13

A plate-position determiner C13 as an example of a stack-member-position determiner determines whether the stack plate 11 is at the raised position or not, based on a control signal of the raising/lowering controller C10.

Suction-Completion Determiner C14

A suction-completion determiner C14 includes a timer TM as an example of a timer that measures a predetermined suction-completion time ta, based on a time from when the suction is started to when the sealing skirt 36 moves to the raised position. The suction-completion determiner C14 determines whether the suction of the recording sheet S by the suction head 22 is completed or not. If the suction-completion time ta elapses since the exhaust fan HF starts driving, the suction-completion determiner C14 according to the first exemplary embodiment determines that the suction of the recording sheet S by the suction head 22 is completed.

Description of Flowchart According to First Exemplary Embodiment

Next, the flow of processing of the image forming apparatus U according to the first exemplary embodiment of the present invention is described with reference to a flowchart.

Figure 11:
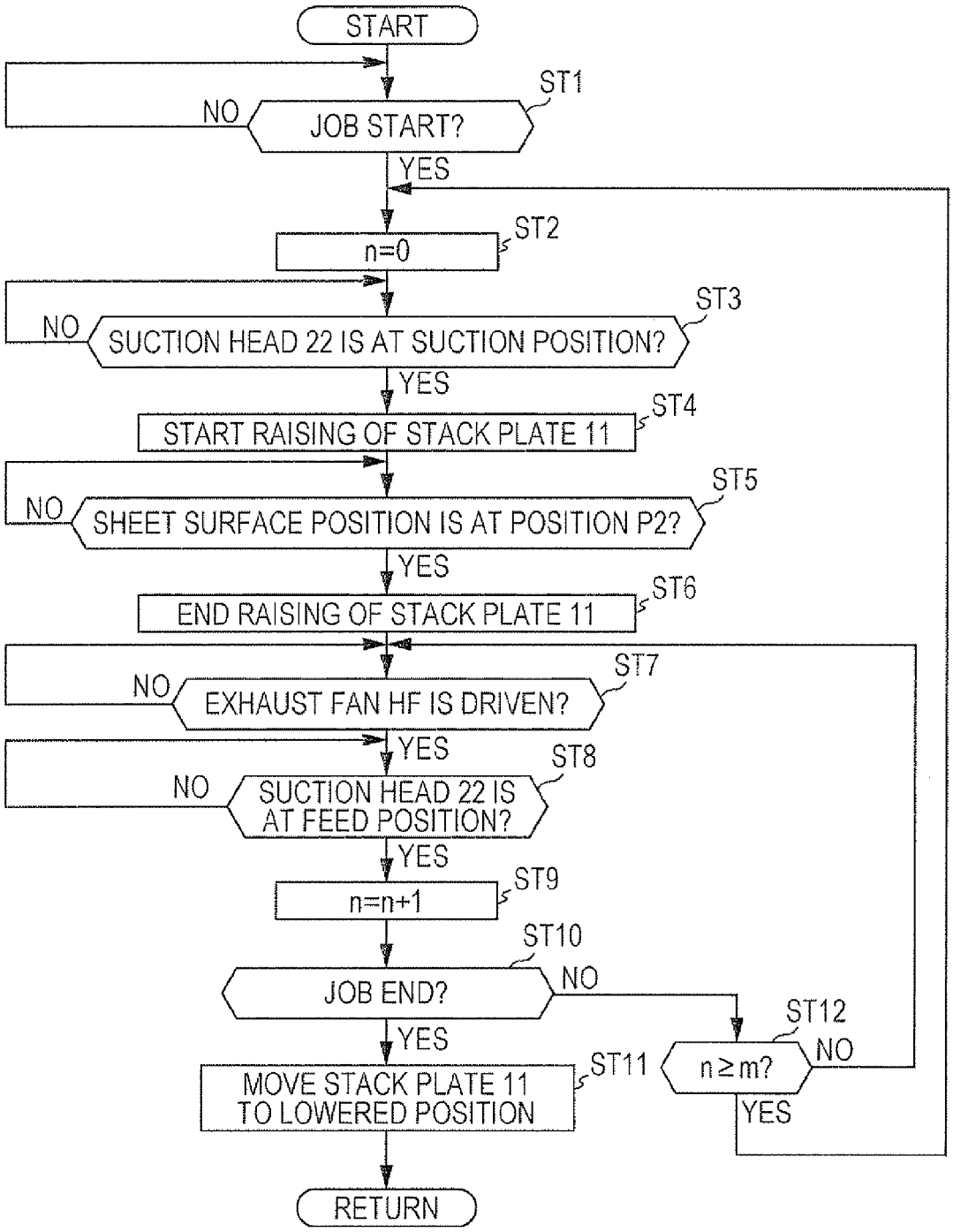
FIG. 11 is a flowchart of raising/lowering control processing of the stack plate of each sheet feed tray according to the first exemplary embodiment of the present invention.

Description of Flowchart for Raising/Lowering Control Processing of Sheet Feed Trays TR1 and TR2 according to First Exemplary Embodiment FIG. 11 is a flowchart of raising/lowering control processing of the stack plate of each sheet feed tray according to the first exemplary embodiment of the present invention.

Processing of respective steps ST in the flowchart of FIG. 11 is executed in accordance with programs stored in the controller C of the image forming apparatus U. Also, this processing is executed by parallel processing in parallel to other processing of the image forming apparatus U for the sheet feed tray TR1 or TR2.

The flowchart shown in FIG. 11 starts when power is applied to the image forming apparatus U.

In ST1 of FIG. 11, it is determined whether a job is started or not. If YES, the processing goes to ST2. If NO, the processing returns to ST1.

In ST2, the counter n is reset to 0, and the processing goes to ST3.

In ST3, it is determined whether the suction head 22 is at the suction position or not. If YES, the processing goes to ST4. If NO, the processing returns to ST3.

In ST4, raising of the stack plate 11 is started, and the processing goes to ST5.

In ST5, it is determined whether the sheet surface position of the stack plate 11 is at the position P2 corresponding to the detected position or not. If YES, the processing goes to ST6. If NO, the processing returns to ST5.

In ST6, raising of the stack plate 11 is ended, the stack plate 11 moves to the raised position, and the processing goes to ST7.

In ST7, it is determined whether the exhaust fan HF is driven or not. If YES, the processing goes to ST8. If NO, the processing returns to ST7.

In ST8, it is determined whether the suction head 22 is at the feed position or not. If YES, the processing goes to ST9. If NO, the processing returns to ST8.

In ST9, the counter n is incremented by 1, and the processing goes to ST10.

In ST10, it is determined whether the job is ended or not. If YES, the processing goes to STI1. If NO, the processing goes to ST12.

In ST11, the stack plate 11 is moved to the retracted position, and the processing returns to ST1.

In ST12, it is determined whether the value of the counter n is the number m or larger. If YES, the processing goes to ST2. If NO, the processing goes to ST7.

Figure 12:
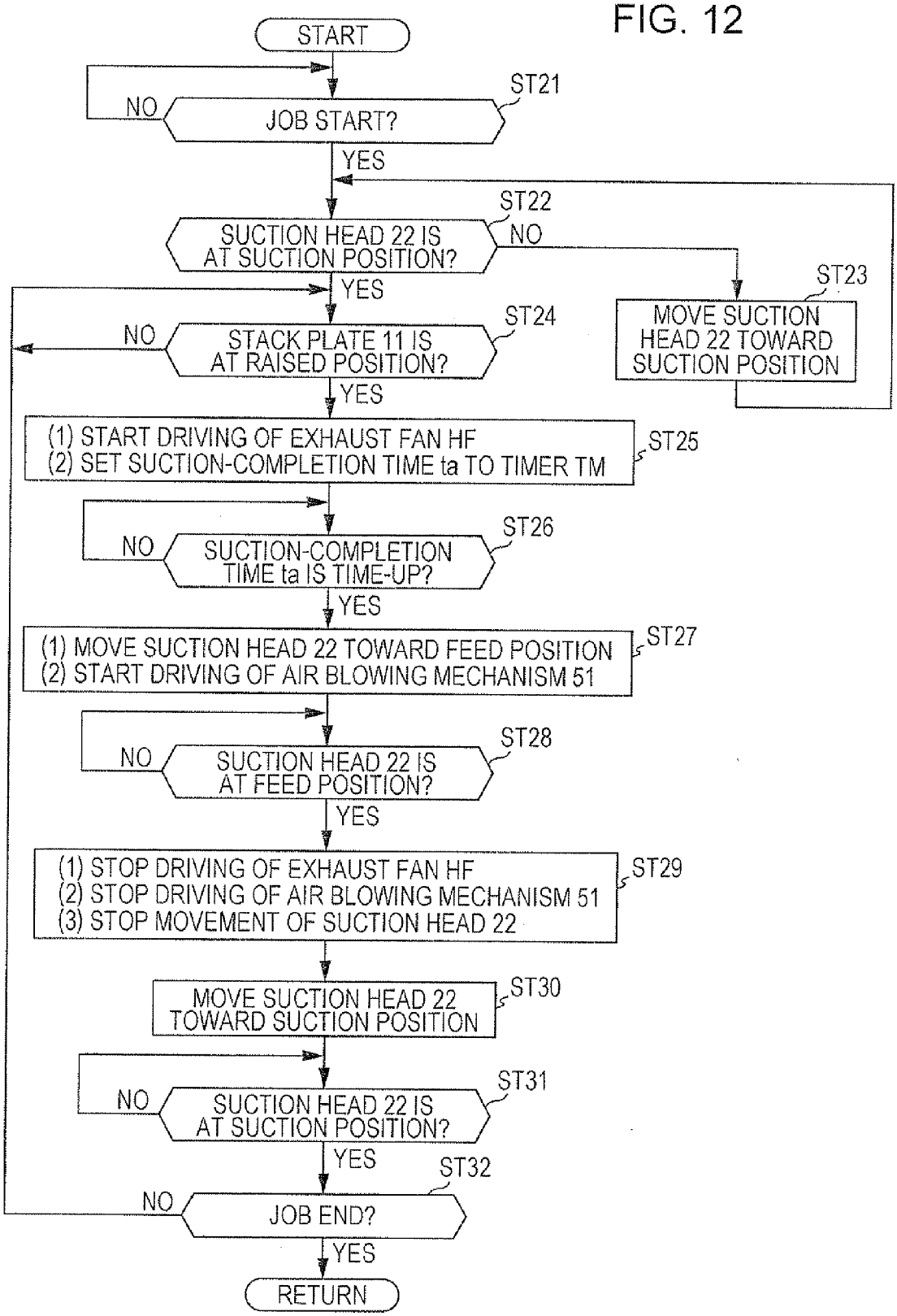
FIG. 12 is a flowchart of sheet feed processing of each sheet feed tray according to the first exemplary embodiment of the present invention.

Description of Flowchart for Sheet Feed Processing of Sheet Feed Trays Tr1 and Tr2 According to First Exemplary Embodiment FIG. 12 is a flowchart of sheet feed processing of each sheet feed tray according to the first exemplary embodiment of the present invention.

Processing of respective steps ST in the flowchart of FIG. 12 is executed in accordance with programs stored in the controller C of the image forming apparatus U. Also, this processing is executed by parallel processing in parallel to other processing of the image forming apparatus U for the sheet feed tray TR1 or TR2.

The flowchart shown in FIG. 12 starts when power is applied to the image forming apparatus U.

In ST21 of FIG. 12, it is determined whether a job is started or not. If YES, the processing goes to ST22. If NO, the processing returns to ST21.

In ST22, it is determined whether the suction head 22 is at the suction position or not. If YES, the processing goes to ST24. If NO, the processing goes to ST23.

In ST23, the suction head 22 is moved toward the suction position, and the processing returns to ST22.

In ST24, it is determined whether the stack plate 11 is at the raised position or not. If YES, the processing goes to ST25. If NO, the processing returns to ST24.

In ST25, the following processing (1) and processing (2) are executed, and the processing goes to ST26.

(1) Driving of the exhaust fan HF is started.

(2) The suction-completion time ta is set in the timer TM.

In ST26, it is determined whether the suction-completion time ta has elapsed or not (time-up). If YES, the processing goes to ST27. If NO, the processing returns to ST26.

In ST27, the following processing (1) and processing (2) are executed, and the processing goes to ST28.

(1) The suction head 22 is moved toward the feed position.

(2) Driving of the air blowing mechanism 51 is started.

In ST28, it is determined whether the suction head 22 is at the feed position or not. If YES, the processing goes to ST29. If NO, the processing returns to ST28.

In ST29, the following processing (1) to processing (3) are executed, and the processing goes to ST30.

(1) Driving of the exhaust fan HF is stopped.

(2) Driving of the air blowing mechanism 51 is stopped.

(3) Movement of the suction head 22 is stopped.

In ST30, the suction head 22 is moved toward the suction position, and the processing goes to ST31.

In ST31, it is determined whether the suction head 22 is at the suction position or not. If YES, the processing goes to ST32. If NO, the processing returns to ST31.

In ST32, it is determined whether the job is ended or not. If YES, the processing returns to ST21. If NO, the processing returns to ST24.

Operation of First Exemplary Embodiment

Figure 13A:
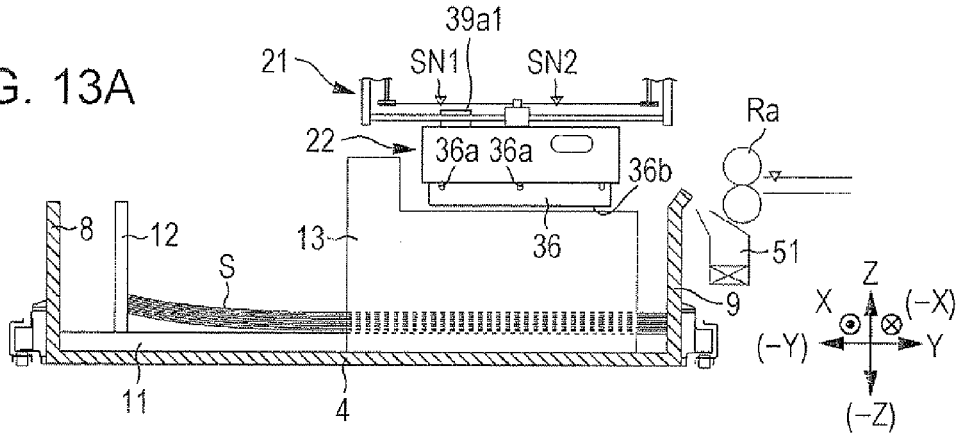
FIGS. 13A to 13C are operation explanatory views according to the first exemplary embodiment, FIG. 13A being an explanatory view in a state in which the stack plate moves to the lowered position, FIG. 13B being an explanatory view in a state in which the stack plate is raised from the state in FIG. 13A and a recording sheet on the stack plate contacts the sealing skirt, FIG. 13C being an explanatory view in a state in which the stack plate is raised from the state in FIG. 13B to the raised position.
Figure 13B:
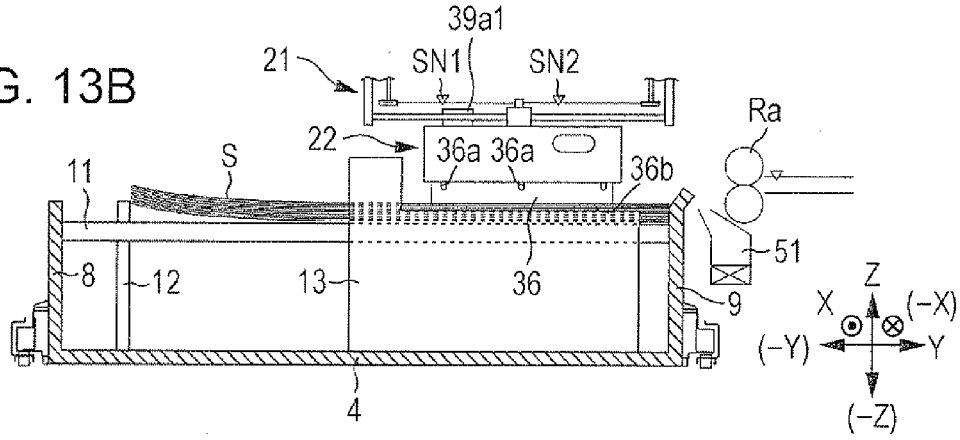
Figure 13C:
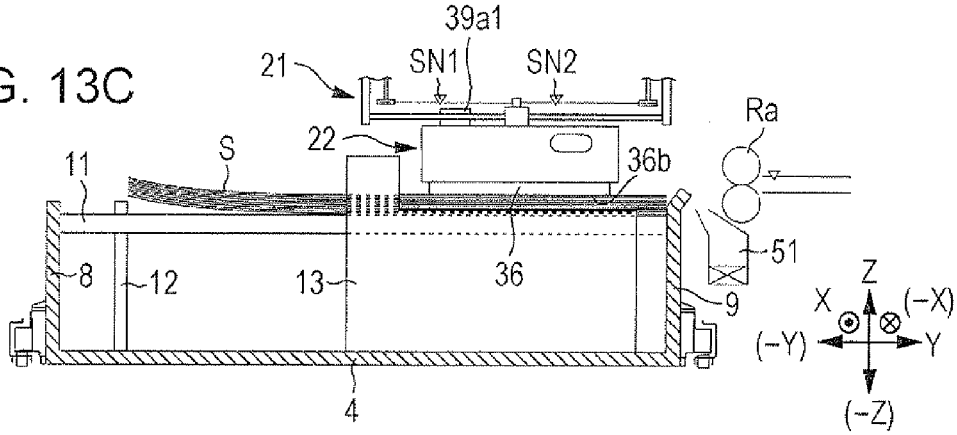

FIGS. 13A to 13C are operation explanatory views according to the first exemplary embodiment, FIG. 13A being an explanatory view in a state in which the stack plate moves to the lowered position, FIG. 13B being an explanatory view in a state in which the stack plate is raised from the state in FIG. 13A and a recording sheet on the stack plate contacts the sealing skirt, FIG. 13C being an explanatory view in a state in which the stack plate is raised from the state in FIG. 13B to the raised position.

With the image forming apparatus U according to the first exemplary embodiment of the present invention having the above-described configuration, as shown in FIG. 13A, the stack plate 11 is held at the lowered position before the job is started, and the stack plate 11 and the recording sheet S are held in a manner separated from the suction head 22. At this time, the sealing skirt 36 is at the lower-limit position by its weight.

When the copy start key is pressed and a job is started, ST2 to ST4 in the raising/lowering control processing shown in FIG. 11 are executed. In particular, the stack plate 11 is raised from the lowered position shown in FIG. 13A toward the suction head 22 which is at the suction position. Then, the recording sheet S on the stack plate 11 which is being raised contacts the distal end 36*b* of the sealing skirt 36 at the lower-limit position, and pushes the sealing skirt 36 upward when the stack plate 11 is raised as shown in FIGS. 13B and 10A. Then, the sealing skirt 36 is raised together with the recording sheet S on the stack plate 11, the distal end 36*b* of the sealing skirt 36 moves toward the head body 23, and hence the sealing skirt 36 moves from the lower-limit position to the detected position as shown in FIG. 10B. When the sealing skirt 36 moves to the detected position, the skirt light-shielding part 38 supported at the sealing skirt 36 is detected by the skirt sensor SN3 of the head body 23. When the skirt light-shielding part 38 is detected by the skirt sensor SN3, ST5 and ST6 in the raising/lowering control processing are executed. In particular, it is determined that the sheet surface position of the recording sheet S on the stack plate 11 is at the position P2, raising of the stack plate 11 is ended, and as shown in FIG. 13C, the stack plate 11 is held at the raised position.

When the stack plate 11 is at the raised position, ST25 to ST26 in the sheet feed processing according to the first exemplary embodiment shown in FIG. 12 are executed. In particular, the exhaust fan HF is driven, and the recording sheet S on the stack plate 11 is sucked to the suction head 22. At this time, if the suction space 37 is sealed by the recording sheet S, the air in the suction space 37 is sucked, and hence the recording sheet S is raised together with the sealing skirt 36. As shown in FIG. 10C, when the sealing skirt 36 is raised and the suction of the recording sheet S is completed, ST27 in the sheet feed processing is executed. In particular, the suction head 22 moves toward the feed position, and driving of the air blowing mechanism 51 is started. Accordingly, when the suction head 22 moves from the suction position to the feed position, the air is blown to the downstream end in the transport direction of the sucked recording sheet S, and if plural recording sheets S are sucked, the plural recording sheets S are separated from each other. When the suction head 22 reaches the feed position, the sucked recording sheet S is provided to the transport rollers Ra, ST29 to ST31 in the sheet feed processing are executed. In particular, driving of the exhaust fan HF and driving of the air blowing mechanism 51 are stopped. Then, the suction head 22 returns from the feed position to the suction position.

When the job is executed and the recording sheet S is fed, ST2 to ST6 in the raising/lowering control processing are executed, and hence raising of the stack plate 11 is started, every time when recording sheets S are fed by the number m. The stack plate 11 is raised and moved to the raised position until it is determined that the sheet surface position, which is lowered because the recording sheet S is sucked and fed, reaches the position P2.

When the job is ended, ST10 and ST11 in the raising/lowering control processing are executed. In particular, the stack plate 11 is lowered from the raised position and returns to the lowered position shown in FIG. 13A.

Figure 14A:
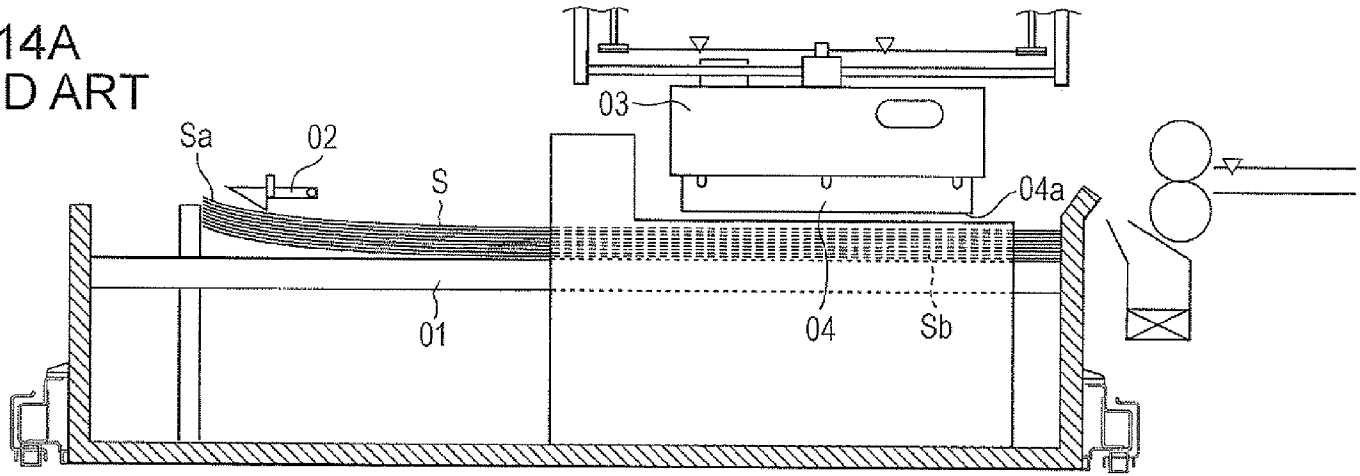
FIG. 14A RELATED ART
FIGS. 14A and 14B are explanatory views when a position of a surface of a recording sheet on a stack plate is detected according to a configuration of related art, FIG. 14A being an explanatory view when recording sheets with upstream portions thereof in a transport direction being curved are stacked, FIG. 14B being an explanatory view when envelopes with upstream portions thereof in the transport direction being thick are stacked.
Figure 14B:
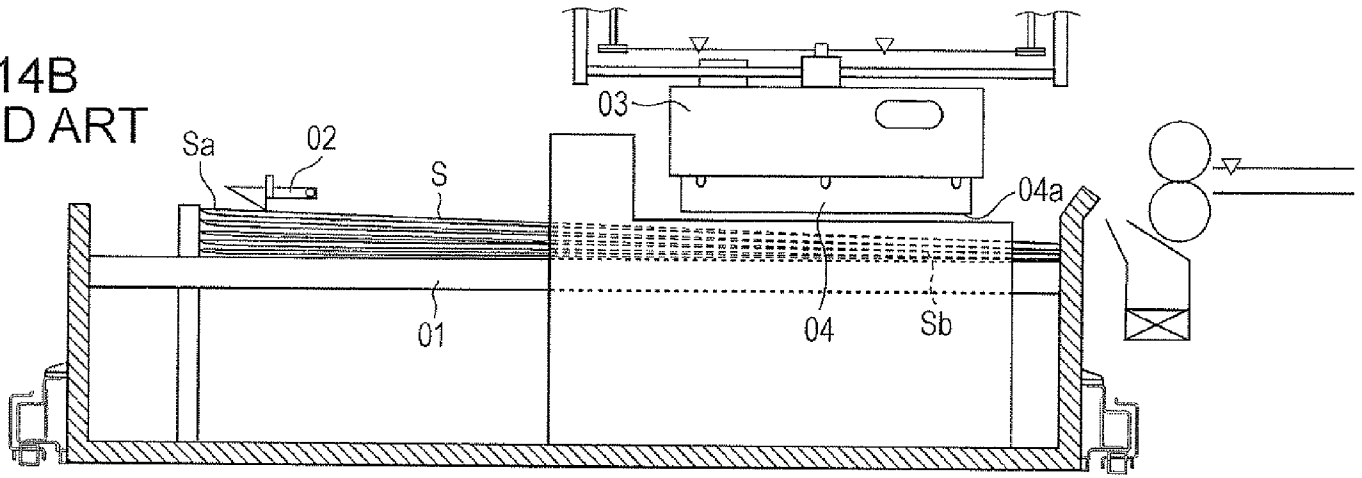
FIG. 14B RELATED ART

FIGS. 14A and 14B are explanatory views when a position of a surface of a recording sheet on a stack plate is detected according to a configuration of related art, FIG. 14A being an explanatory view when recording sheets with upstream portions thereof in a transport direction being curved are stacked, FIG. 14B being an explanatory view when envelopes with upstream portions thereof in the transport direction being thick are stacked.

Figure 15A:
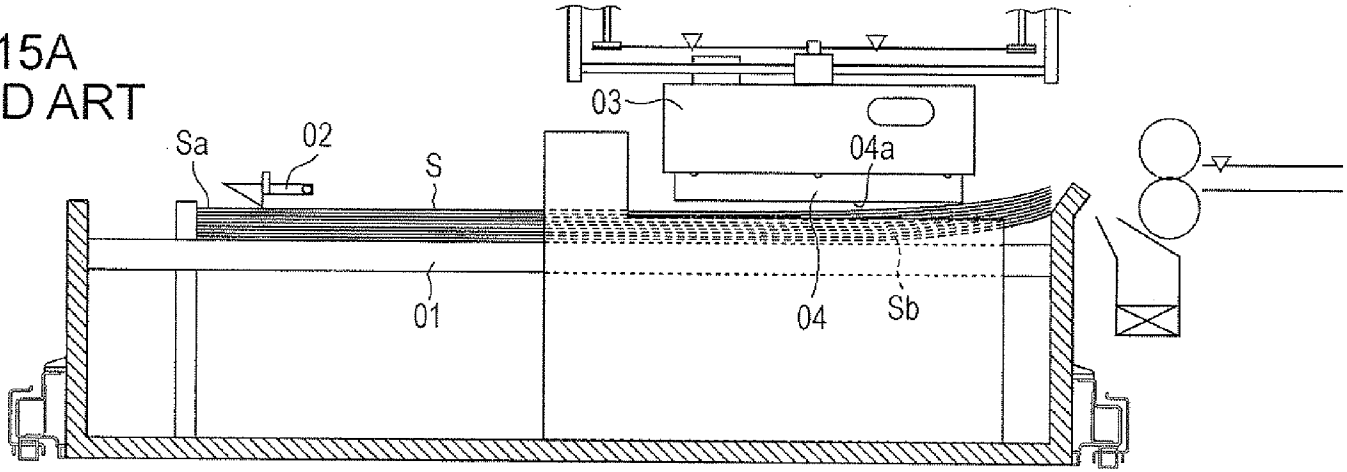
FIG. 15A RELATED ART
FIGS. 15A and 15B are explanatory views when a position of a surface of a recording sheet on the stack plate is detected according to the configuration of related art, FIG. 15A being an explanatory view when recording sheets with downstream portions thereof in the transport direction being curved are stacked, FIG. 15B being an explanatory view when envelopes with downstream portions thereof in the transport direction being thick are stacked.
Figure 15B:
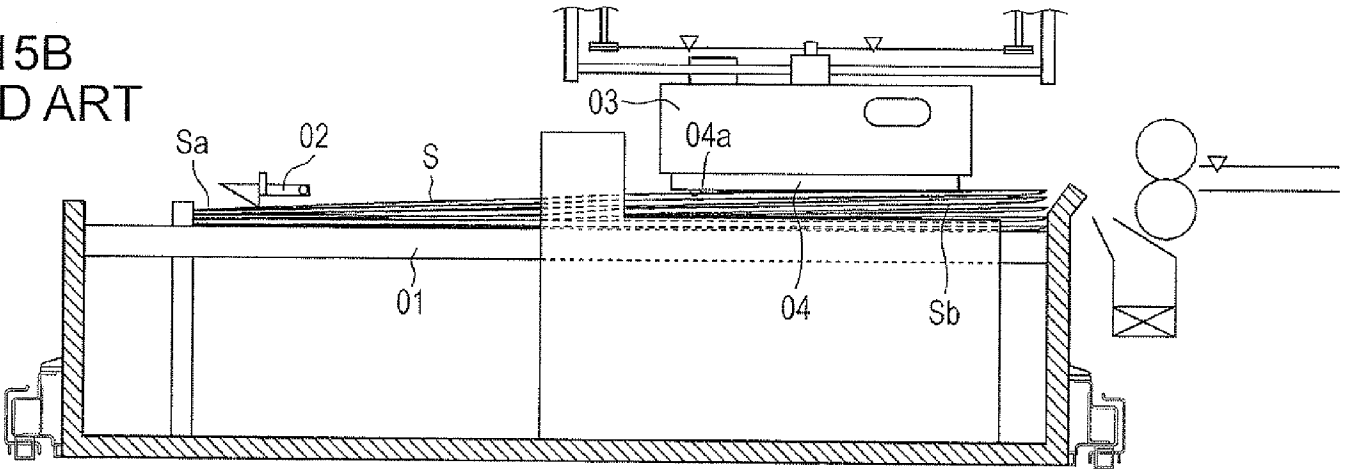
FIG. 15B RELATED ART

FIGS. 15A and 15B are explanatory views when a position of a surface of a recording sheet on the stack plate is detected according to the configuration of related art, FIG. 15A being an explanatory view when recording sheets with downstream portions thereof in the transport direction being curved are stacked, FIG. 15B being an explanatory view when envelopes with downstream portions thereof in the transport direction being thick are stacked.

In FIGS. 14A, 14B, 15A, and 15B, in a configuration of related art, a detecting member 02 is provided at an upstream position in a transport direction of a recording sheet S on a stack plate 01. The detecting member 02 detects a state of an upstream portion Sa in the transport direction of the recording sheet S, and the stack plate 01 is moved based on the state of the upstream portion Sa in the transport direction of the recording sheet S.

As shown in FIG. 14A or 15A, an end portion Sa or Sb in the transport direction of the recording sheet S to be used may be curved, i.e., curled, or as shown in FIG. 14B or 155, in a case in which the recording sheet S is an envelope, one end portion Sa or Sb in the transport direction of the recording sheet S may be thicker than the other end portion Sb or Se in the transport direction. With the configuration of related art, even if the stack plate 01 is moved based on a detection result of the detecting member 02, a surface position of the recording sheet S near the detecting member 02 may differ from a surface position of the recording sheet S near a suction head 03. Hence, if movement of the stack plate 01 is controlled based on the detecting member 02, a positional relationship between a head body of the suction head 03 or a distal end 04*e* of a sealing skirt 04 and a topmost surface of recording sheets S may be shifted from a predetermined positional relationship. Even if the recording sheet S is intended to be sucked to the suction head 03, suction may take a time or suction may be failed because a distance between the recording sheet S and the sealing skirt 36 is too large. Also, the recording sheet S on the stack plate 01 may be too close to the head body, the recording sheet S may be sucked by a larger force than a required force, and a wrinkle may remain on the recording sheet S. Therefore, with the configuration of related art, suction is not properly made such that suction takes a time, suction is failed, and a wrinkle remains on the recording sheet. A suction failure may occur.

In contrast, in the first exemplary embodiment, the skirt light-shielding part 38, which moves in association with movement of the distal end 36*b* of the sealing skirt 36 is supported at the sealing skirt 36, the skirt light-shielding part 38 is detected by the skirt sensor SN3, and hence the surface position of the recording sheet S is detected. That is, in the first exemplary embodiment, the recording sheet S on the stack plate 11 contacts the distal end 36*b* of the sealing skirt 36, and hence the surface position of the recording sheet S is detected through the sealing skirt 36. According to the first exemplary embodiment, movement of the stack plate 11 is controlled based on the position of a portion of the recording sheet S, the portion which contacts the distal end 36*b* of the sealing skirt 36, i.e., the portion which is actually sucked. Accordingly, a positional relationship between the distal end 36*b* of the sealing skirt 36 and the actually sucked portion of the recording sheet S likely matches a predetermined positional relationship. A suction failure is likely reduced as compared with the configuration of related art.

In a case of a configuration in which a rotating member contacts a surface of a medium and sends out the medium, like a pickup roller, if the rotating member is rotated at a high speed to increase the number of fed media per unit time, the rotating member may slip on the medium to be sent out. If slipping occurs between the rotating member and the medium, a send-out timing may be shifted. The interval between media to be transported may be unstable, and paper clogging or so-called paper jam may occur. Owing to this, with the configuration in which the rotating member contacts the surface of the medium and sends out the medium, the interval between the media has to be long by a certain degree to prevent paper jam from occurring even though the interval between the media is unstable. Thus, it has been difficult to increase the number of media to be fed per unit time. In contrast, with the configuration in which a suction member sucks a medium and feeds the medium, slipping hardly occurs on the medium. The interval between media to be transported likely becomes stable, and the number of media to be fed per unit time is easily increased. Thus, with the configuration in which the suction head 22 sucks the recording sheet S according to the first exemplary embodiment, a suction failure of the suction head 22 hardly occurs, and the number of recording sheets S to be fed per unit time is easily increased as compared with the configuration of related art.

Second Exemplary Embodiment

Figure 16:
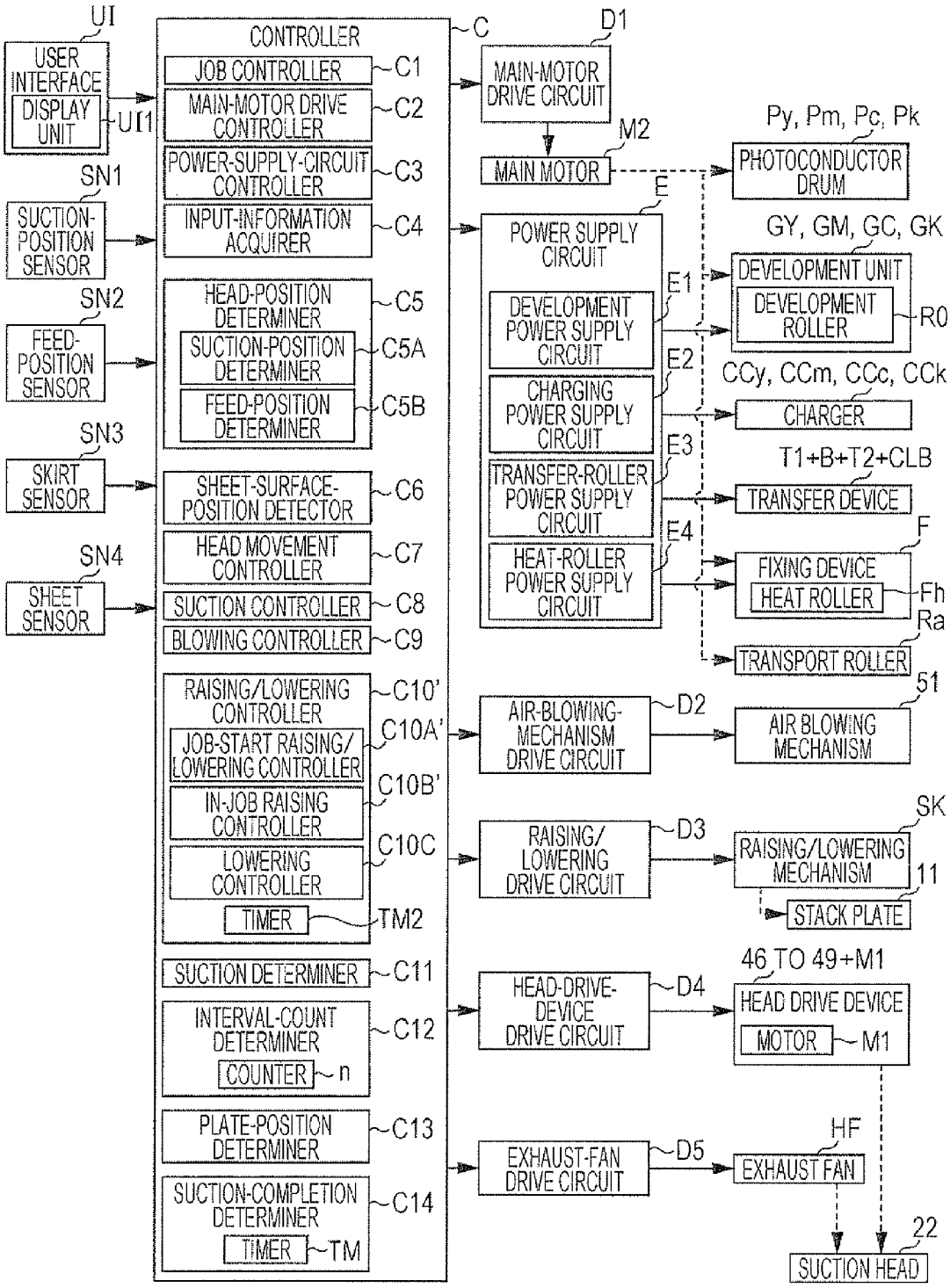
FIG. 16 is a block diagram showing functions included in a controller of an image forming apparatus according to a second exemplary embodiment and corresponds to FIG. 9 of the first exemplary embodiment.

FIG. 16 is a block diagram showing functions included in a controller of an image forming apparatus according to a second exemplary embodiment and corresponds to FIG. 9 of the first exemplary embodiment.

Next, the second exemplary embodiment of the present invention is described. In description of the second exemplary embodiment, like reference signs refer like components corresponding to the components of the first exemplary embodiment, and detailed description is omitted.

This exemplary embodiment differs from the first exemplary embodiment in the following points. Other points of this exemplary embodiment are similar to those of the first exemplary embodiment.

In FIG. 16, a controller C according to the second exemplary embodiment includes a raising/lowering controller C10' according to the second exemplary embodiment, instead of the raising/lowering controller C10 according to the first exemplary embodiment.

Figure 17A:
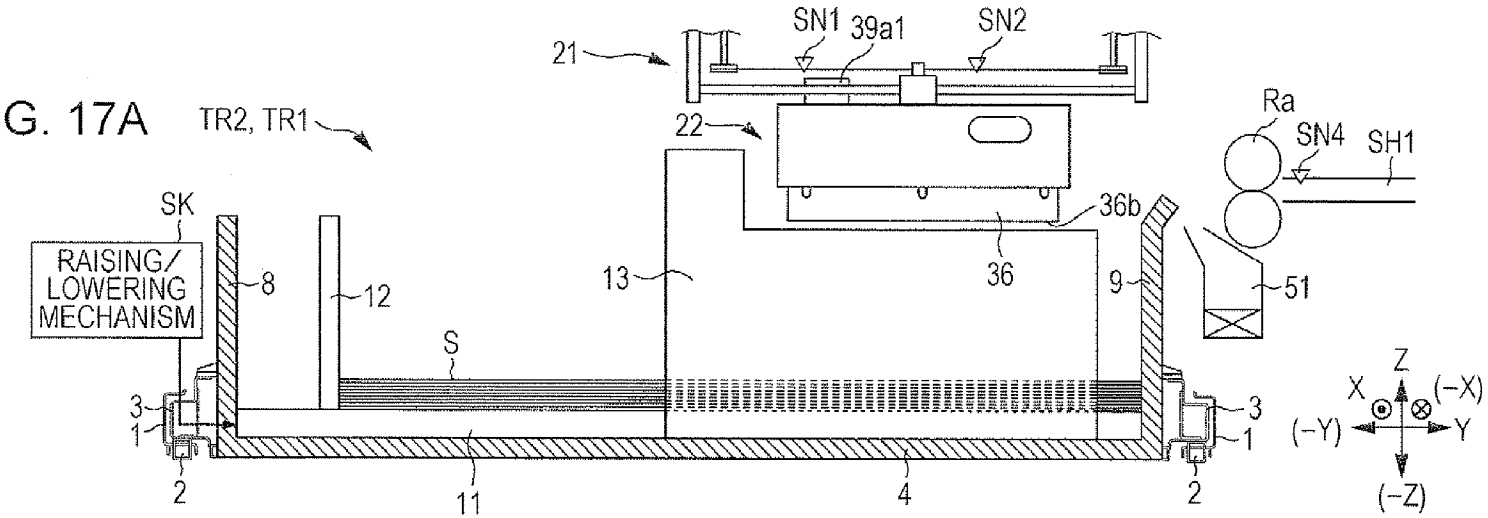
FIGS. 17A and 17B are explanatory views of positions of a stack plate according to the second exemplary embodiment, FIG. 17A being an explanatory view in a state in which the stack plate moves to a lowered position, FIG. 17B being an explanatory view in a state in which the stack plate moves to a raised position.
Figure 17B:
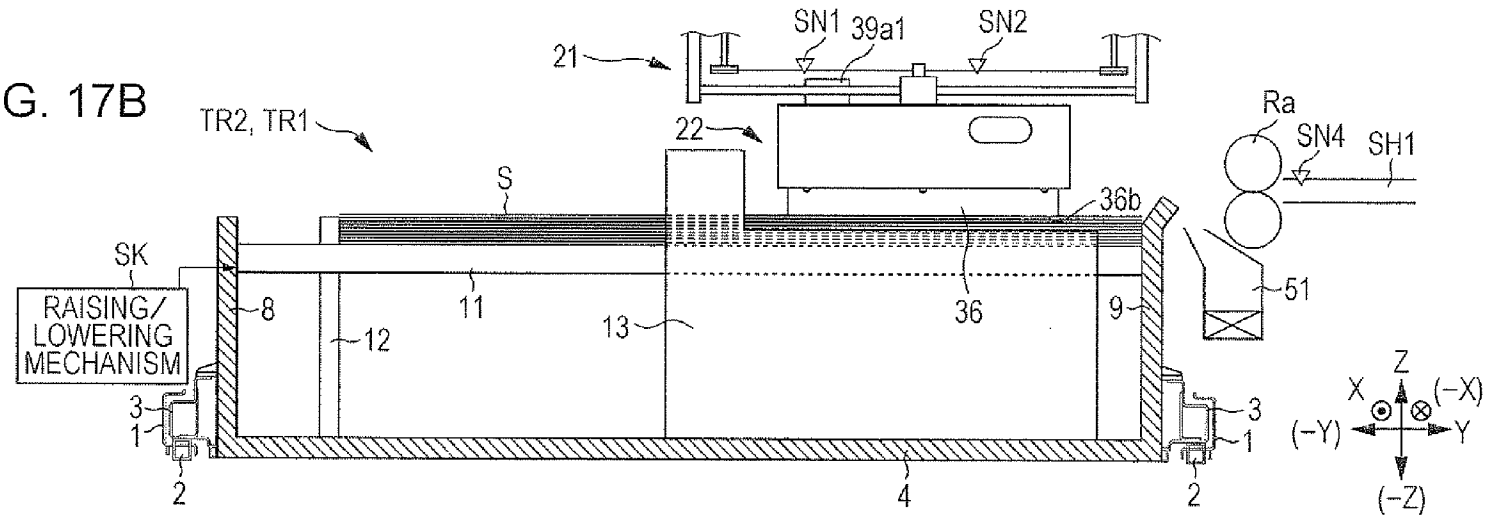

FIGS. 17A and 17B are explanatory views of positions of a stack plate according to the second exemplary embodiment, FIG. 17A being an explanatory view in a state in which the stack plate moves to a lowered position. FIG. 17B being an explanatory view in a state in which the stack plate moves to a raised position.

Raising/Lowering Controller C10'

The raising/lowering controller C10' according to the second exemplary embodiment includes a job-start raising/lowering controller C10A', an in-job raising controller C10B', a lowering controller C10C that is similar to the lowering controller C10C of the first exemplary embodiment, and a timer TM2 that measures predetermined times tb and tc. The raising/lowering controller C10' controls driving of the raising/ lowering mechanism SK through the raising/lowering drive circuit D3 so as to raise or lower the stack plate 11 between the raised position shown in FIG. 17A and the lowered position shown in FIG. 17B.

Job-Start Raising/Lowering Controller C10A'

If a first recording sheet S at start of a job is fed, the job-start raising/lowering controller C10A' performs control to raise the stack plate 11 to the raised position, based on a detection result of the sheet-surface-position detector C6. The job-start raising/lowering controller C10A' according to the second exemplary embodiment first raises the stack plate 11 in a manner similar to the job-start raising controller C10A according to the first exemplary embodiment, and then lowers the stack plate 11 only for a predetermined job-start lowering time tb. In particular, the raising/lowering controller C10A' according to the second exemplary embodiment first raises the stack plate 11 from the lowered position shown in FIG. 17A until the sheet-surface-position detector C6 detects that the sheet surface position is located at the position P2 that is raised from the position P1 corresponding to the lower-limit position by the distance L1. Then, if it is detected that the sheet surface position is at the position P2, the job-start raising/lowering controller C10A' according to the second exemplary embodiment lowers the stack plate 11 for the job-start lowering time tb and move the stack plate 11 to the raised position shown in FIG. 17B.

In-Job Raising Controller C10B'

When a job is executed, recording sheets S stacked on the stack plate 11 are reduced, and a topmost surface of the recording sheets S is lowered, the in-job raising controller C10B' according to the second exemplary embodiment performs control to raise and move the stack plate 11 in a stationary state to the raised position every time when recording sheets are fed by the predetermined number m until an in-job raising time tc elapses, the in-job raising time tc which is predetermined based on the number m, the thickness of a recording sheet S, etc.

Description of Flowchart According to Second Exemplary Embodiment

Next, the flow of processing of the image forming apparatus U according to the second exemplary embodiment of the present invention is described with reference to a flowchart.

Figure 18:
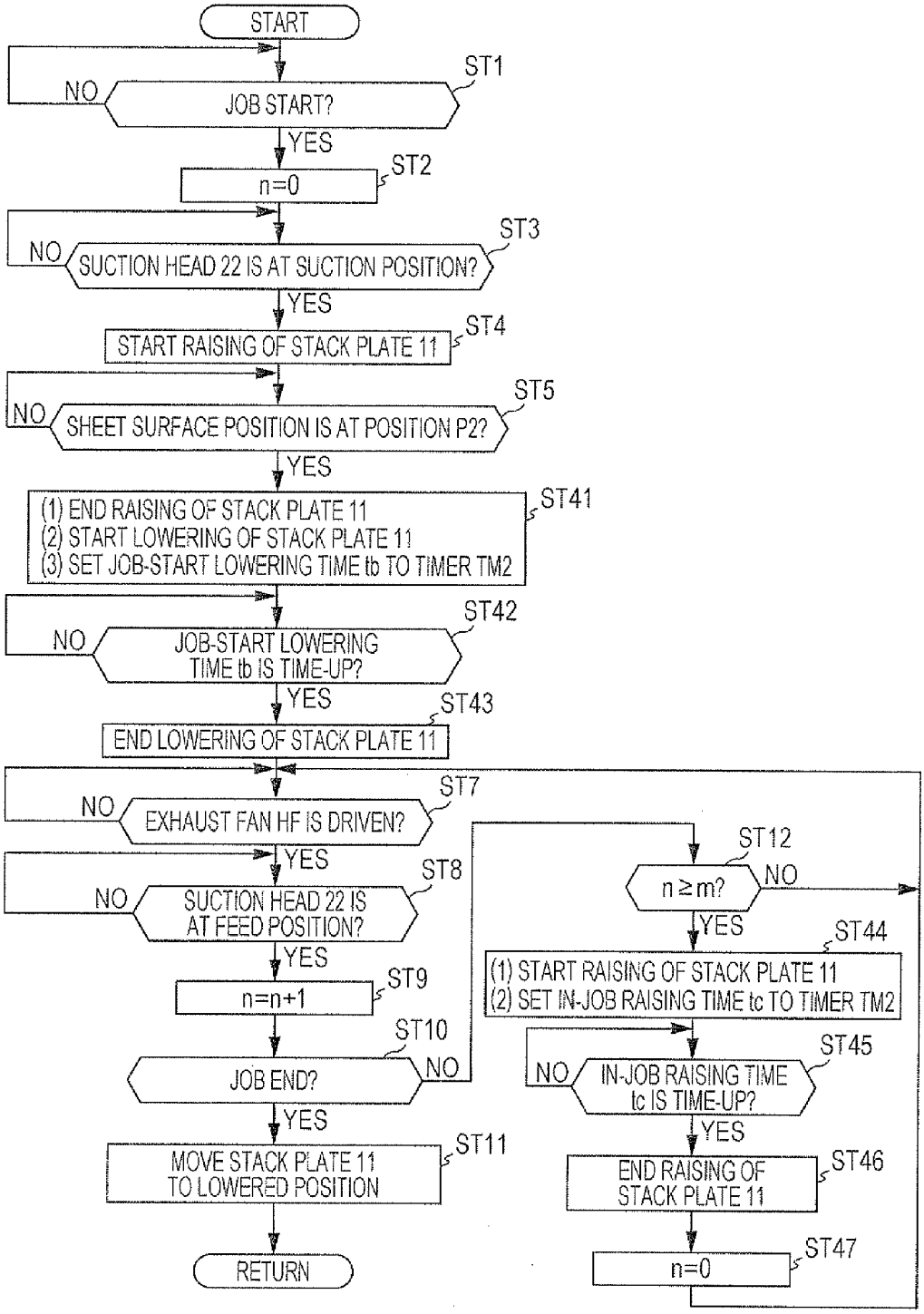
FIG. 18 is a flowchart of raising/lowering control processing according to the second exemplary embodiment of the preset invention and corresponds to FIG. 11 of the first exemplary embodiment.

Description of Flowchart for Raising/lowering Control Processing according to Second Exemplary Embodiment FIG. 18 is a flowchart of raising/lowering control processing according to the second exemplary embodiment of the preset invention and corresponds to FIG. 11 of the first exemplary embodiment.

Referring to FIG. 18, in the raising/lowering control processing according to the second exemplary embodiment, ST41 to ST43 are executed instead of ST6 in the raising/lowering control processing according to the first exemplary embodiment. Also, in the raising/lowering control processing according to the second exemplary embodiment, if YES in ST12, ST44 to ST47 are executed. The processing other than ST41 to ST43, and ST44 to ST47 are similar to that of the first exemplary embodiment. Detailed description of the processing similar to that of the first exemplary embodiment is omitted.

In ST41 in FIG. 18, the following processing (1) to processing (3) are executed, and the processing goes to ST42.

(1) Raising of the stack plate 11 is ended.

(2) Lowering of the stack plate 11 is started.

(3) The job-start lowering time tb is set in the timer TM2.

In ST42, it is determined whether the job-start lowering time tb has elapsed or not (time-up). If YES, the processing goes to ST43. If NO, the processing returns to ST42.

In ST43, lowering of the stack plate 11 is ended, and the processing goes to ST7 in FIG. 18.

If YES in ST12 in FIG. 18, the processing goes to ST44. If NO, the processing goes to ST7.

In ST44, the following processing (1) and processing (2) are executed, and the processing goes to ST45.

(1) Raising of the stack plate 11 is started.

(2) The in-job raising time to is set in the timer TM2.

In ST45, it is determined whether the in-job raising time tc has elapsed or not (time-up). If YES, the processing goes to ST46. If NO, the processing returns to ST45.

In ST46, raising of the stack plate 11 is ended, and the processing goes to ST47.

In ST47, the counter n is reset to 0, and the processing returns to ST7 in FIG. 18.

Operation of Second Exemplary Embodiment

Figure 19A:
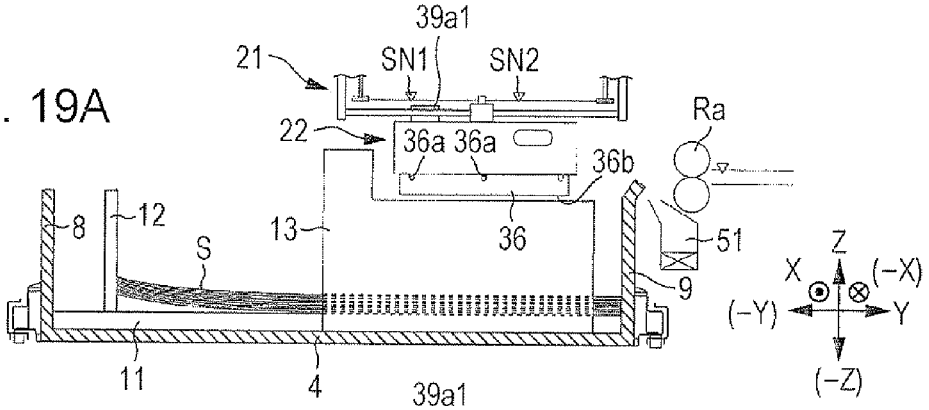
FIGS. 19A to 19D are operation explanatory views according to the second exemplary embodiment, FIG. 19A being an explanatory view in a state in which the stack plate moves to the lowered position and corresponding to FIG. 13A of the first exemplary embodiment, FIG. 19B being an explanatory view in a state in which the stack plate is raised from the state in FIG. 19A and a recording sheet on the stack plate contacts a sealing skirt and corresponding to FIG. 13B of the first exemplary embodiment, FIG. 19C being an explanatory view in a state in which the stack place is raised from the state in FIG. 19B and the sealing skirt moves to a detected position and corresponding to FIG. 13C of the first exemplary embodiment, FIG. 19D being an explanatory view in a state in which the stack plate is lowered from the state in FIG. 19C and moves to the raised position.
Figure 19B:
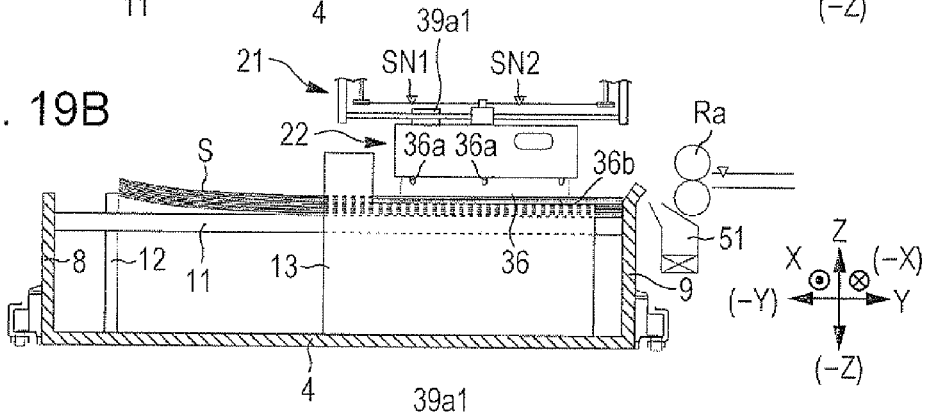
Figure 19C:
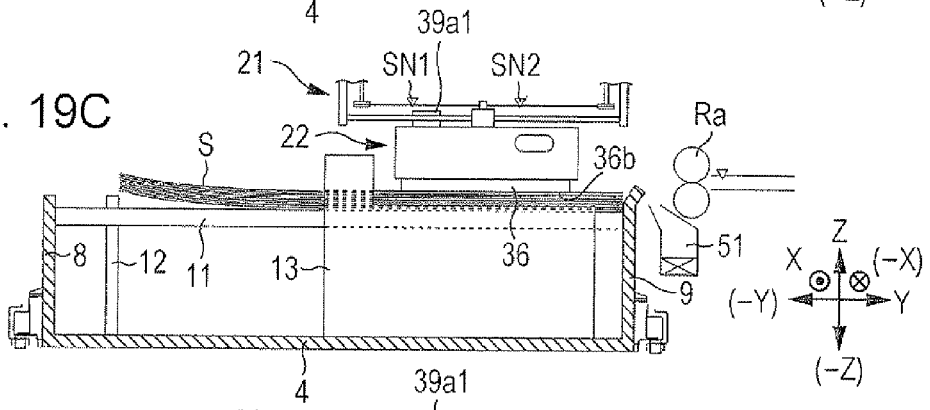
Figure 19D:
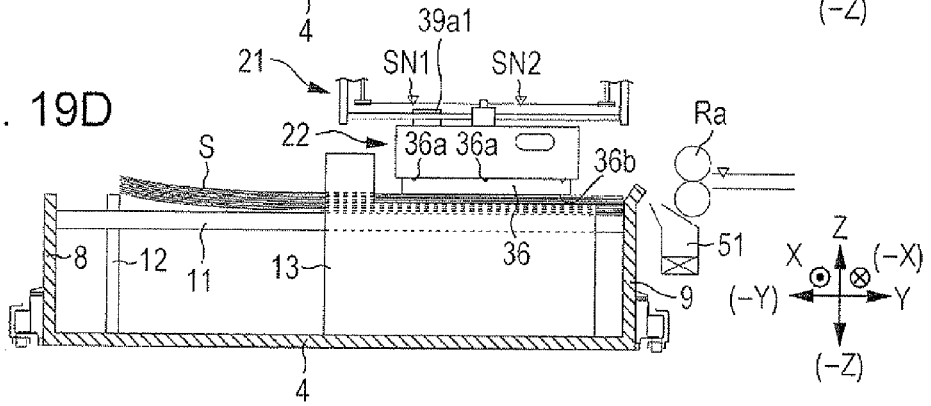

FIGS. 19A to 19D are operation explanatory views according to the second exemplary embodiment, FIG. 19A being an explanatory view in a state in which the stack plate moves to the lowered position and corresponding to FIG. 13A of the first exemplary embodiment, FIG. 19B being an explanatory view in a state in which the stack plate is raised from the state in FIG. 19A and a recording sheet on the stack plate contacts a sealing skirt and corresponding to FIG. 13B of the first exemplary embodiment, FIG. 19C being an explanatory view in a state in which the stack place is raised from the state in FIG. 19B and the sealing skirt moves to a detected position and corresponding to FIG. 13C of the first exemplary embodiment, FIG. 19D being an explanatory view in a state in which the stack plate is lowered from the state in FIG. 19C and moves to the raised position.

With the image forming apparatus U according to the second exemplary embodiment of the present invention having the above-described configuration, when the copy start key is pressed, ST1 to ST5 in the raising/lowering control processing according to the second exemplary embodiment are executed. In particular, as shown in FIGS. 19A to 19C, like the first exemplary embodiment, the stack plate 11 is raised from the lowered position, the recording sheet S on the stack plate 11 contacts the sealing skirt 36, and the sealing skirt 36 is raised together with the recording sheet S on the stack plate 11.

If the skirt light-shielding part 38 of the sealing skirt 36 is detected and it is determined that the sheet surface position of the recording sheet S on the stack plate 11 is at the position P2, ST41 to ST43 in the raising/lowering control processing are executed. In particular, the stack plate 11 is lowered until the job-start lowering time tb elapses. Hence, in the second exemplary embodiment, the stack plate 11 moves to the raised position shown in FIG. 19D. When the job is executed, the recording sheet S is sucked to the suction head 22 from the stack plate 11 at the raised position. In the second exemplary embodiment, ST44 to ST47 in the raising/lowering control processing are executed every time when a job is executed and recording sheets are fed by the number m. In particular, the stack plate 11 is raised and moved to the raised position for the predetermined in-job raising time to.

Hence, in the second exemplary embodiment, the surface position of the recording sheet S is detected through the sealing skirt 36, and movement of the stack plate 11 is controlled based on the position of the actually sucked portion of the recording sheet S. Accordingly, in the second exemplary embodiment, like the first exemplary embodiment, a positional relationship between the distal end 36*b* of the sealing skirt 36 and the actually sucked portion of the recording sheet S likely matches a predetermined positional relationship. A suction failure is likely reduced as compared with the configuration of related art.

In the second exemplary embodiment, the stack plate 11 is moved to the raised position by raising the stack plate 11 until the skirt sensor SN3 detects the skirt light-shielding part 38 and then lowering the stack plate 11 for the predetermined job-start lowering time tb. With application of the configuration according to the second exemplary embodiment, the stack plate 11 is raised at a high speed and is roughly adjusted at start of a job, and when the stack plate 11 is lowered, the stack plate 11 is lowered at a low speed and is finely adjusted to be located at the raised position. Accordingly, even if a configuration is provided in which a stack plate 11 is excessively raised during rough adjustment before raising is stopped, the stack plate 11 is easily moved to the raised position with high accuracy.

Third Exemplary Embodiment

Figure 20:
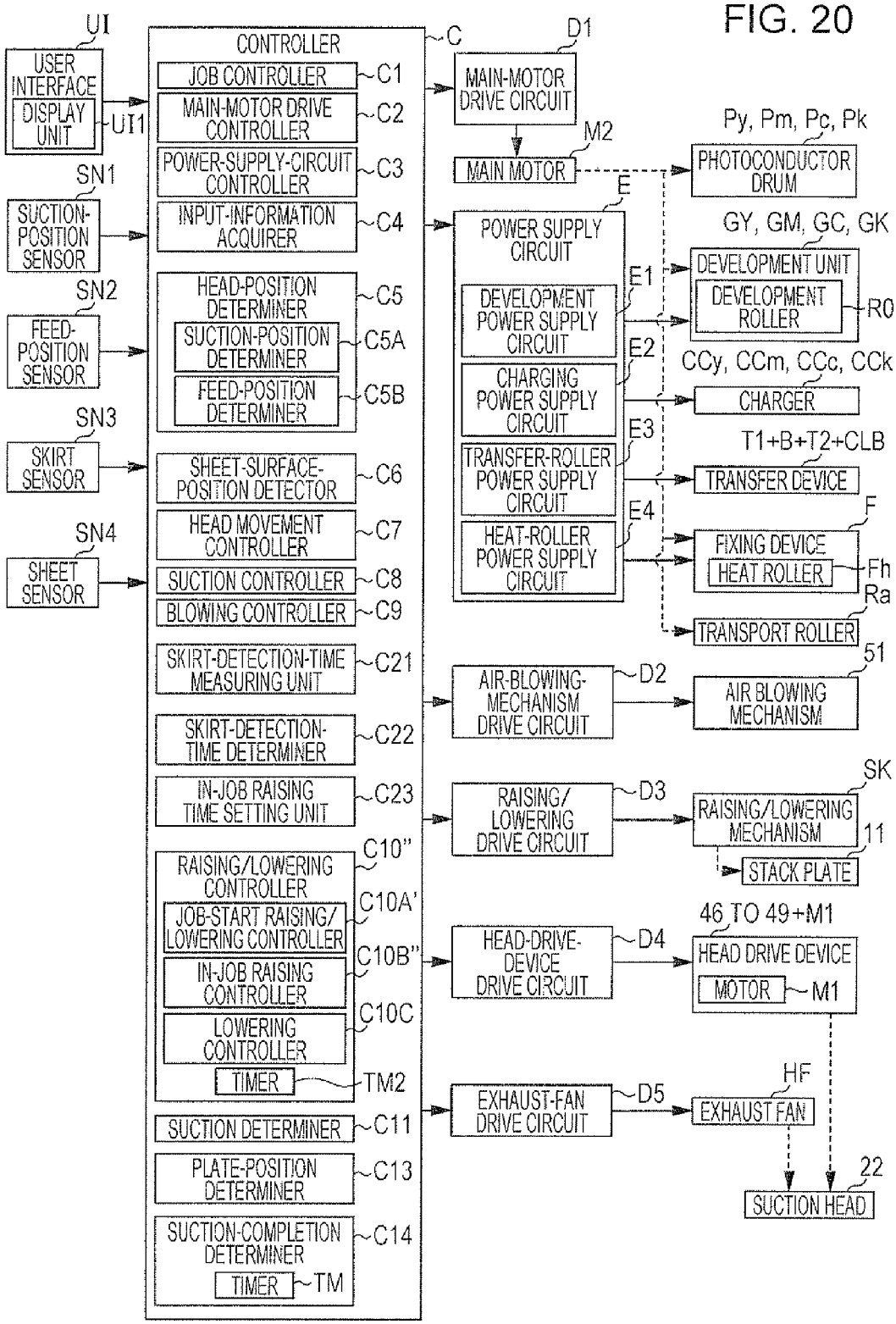
FIG. 20 is a block diagram showing functions included in a controller of an image forming apparatus according to a third exemplary embodiment and corresponds to FIG. 16 of the second exemplary embodiment.

FIG. 20 is a block diagram showing functions included in a controller of an image forming apparatus according to a third exemplary embodiment and corresponds to FIG. 16 of the second exemplary embodiment.

Next, the third exemplary embodiment of the present invention is described. In description of the third exemplary embodiment, like reference signs refer like components corresponding to the components of the second exemplary embodiment, and detailed description is omitted.

This exemplary embodiment differs from the second exemplary embodiment in the following points. Other points of this exemplary embodiment are similar to those of the second exemplary embodiment.

In FIG. 20, a controller C according to the third exemplary embodiment includes a raising/lowering controller C10", a skirt-detection-time measuring unit C21, a skirt-detection-time determiner C22, and an in-job raising-time setting unit C23 according to the third exemplary embodiment, instead of the raising/lowering controller C10' and the interval-count determiner C12 according to the second exemplary embodiment.

Skirt-Detection-Time Measuring Unit C21

The skirt-detection-time measuring unit C21 as an example of a surrounding-member detection-time measuring unit measures a skirt detection time t1 that is from when driving of the exhaust fan HF is started to when the skirt sensor SN3 detects the skirt light-shielding part 38. The skirt-detection-time measuring unit C21 according to the third exemplary embodiment starts measurement of the skirt detection time t1 when driving of the exhaust fan HF is started, based on a control signal of the suction controller C8. Then, the skirt-detection-time measuring unit C21 according to the third exemplary embodiment ends the measurement of the skirt detection time t1 when the skirt sensor SN3 detects the skirt light-shielding part 38, based on a detection signal of the skirt sensor SN3.

Skirt-Detection-Time Determiner C22

The skirt-detection-time determiner C22 determines whether the skirt detection time t1 measured by the skirt-detection-time measuring unit C21 is longer than a reference time t0 that is a predetermined reference time.

In-Job Raising-Time Setting Unit C23

The in-job raising-time setting unit C23 sets an in-job raising time td that is a time for which the stack plate 11 is raised during a job, based on the skirt detection time t1 measured by the skirt-detection-time measuring unit C21. If the skirt-detection-time determiner C22 determines that the skirt detection time t1 is longer than the reference time t0, the in-job raising-time setting unit C23 according to the third exemplary embodiment uses a predetermined margin time $\alpha$, adds the margin time $\alpha$ to the difference between the skirt detection time t1 and the reference time t0 ($td=t1-t0+\alpha$), and sets an in-job raising time td.

Raising/Lowering Controller C10"

The raising/lowering controller C10" according to the third exemplary embodiment includes an in-job raising controller C10B" according to the third exemplary embodiment, instead of the in-job raising controller C10B' according to the second exemplary embodiment.

In-Job Raising Controller C10B"

If the skirt detection time t1 is longer than the reference time t0, the in-job raising controller C10B" according to the third exemplary embodiment moves the stack plate 11 toward the head body 23 and then to the raised position. In particular, if the skirt-detection-time determiner C22 determines that the skirt detection time t1 is longer than the reference time t0, the in-job raising controller C10B" according to the third exemplary embodiment raises and moves the stack plate 11 to the raised position until the in-job raising time td set by the in-job raising-time setting unit C23 elapses.

Description of Flowchart According to Third Exemplary Embodiment

Next, the flow of processing of the image forming apparatus U according to the third exemplary embodiment of the present invention is described with reference to a flowchart.

Figure 21:
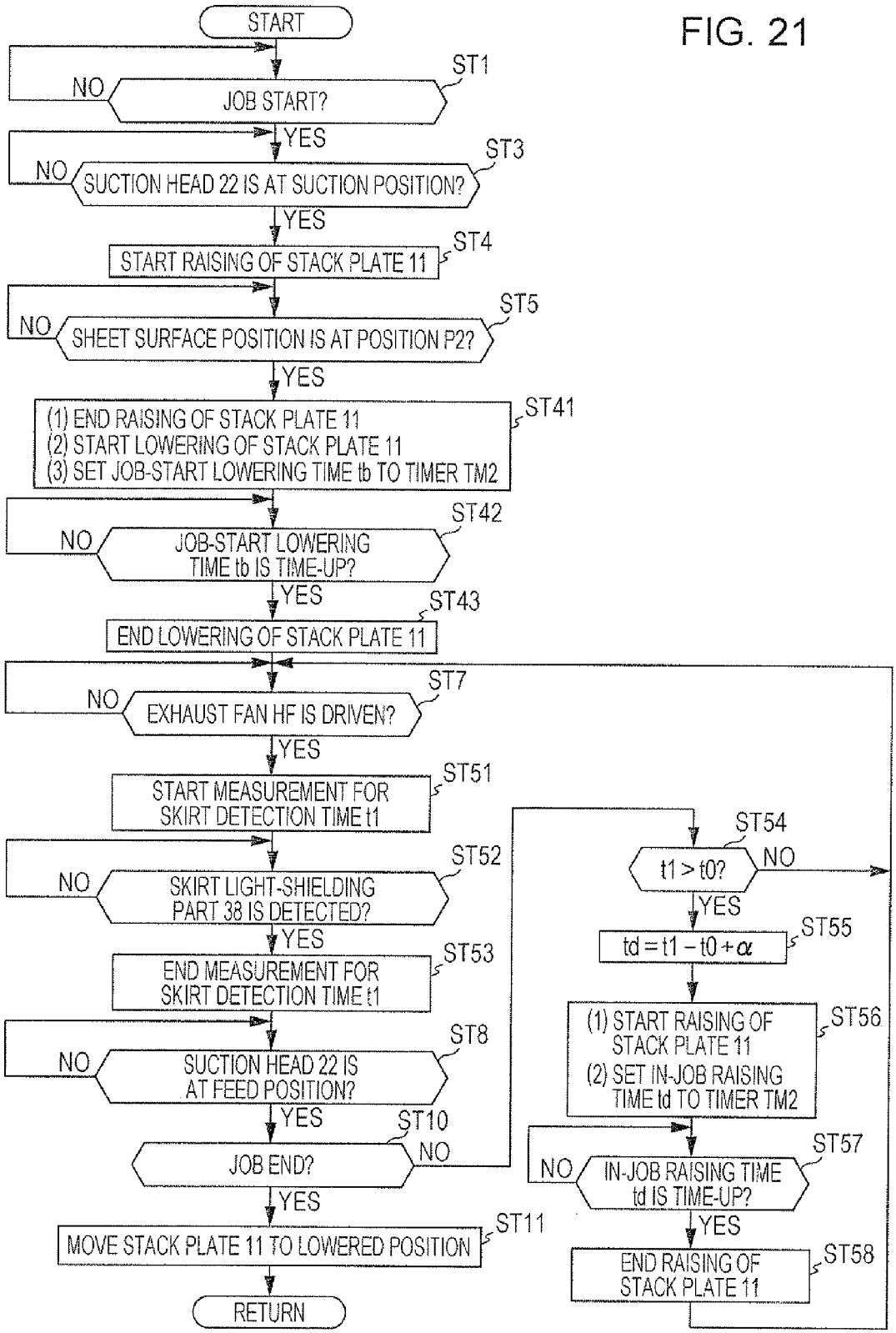
FIG. 21 is a flowchart of raising/lowering control processing according to the third exemplary embodiment of the preset invention and corresponds to FIG. 18 of the second exemplary embodiment.

Description of Flowchart for Raising/lowering Control Processing According to Third Exemplary Embodiment FIG. 21 is a flowchart of raising/lowering control processing according to the third exemplary embodiment of the preset invention and corresponds to FIG. 18 of the second exemplary embodiment.

In FIG. 21, in the raising/lowering control processing according to the third exemplary embodiment, ST2 and ST9 in the raising/lowering control processing according to the second exemplary embodiment are omitted. Also, in the raising/lowering control processing according to the third exemplary embodiment, ST51 to ST53 are executed between ST7 and ST8. Further, in the raising/lowering control processing according to the third exemplary embodiment, ST54 to ST58 are executed instead of ST12, and ST44 to ST47 in the raising/lowering control processing according to the second exemplary embodiment. The processing other than ST51 to ST53, and ST54 to ST58 according to the third exemplary embodiment are similar to that of the second exemplary embodiment. Detailed description of the processing similar to that of the second exemplary embodiment is omitted.

In ST51 in FIG. 21, measurement of the skirt detection time t1 is started, and the processing goes to ST52.

In ST52, it is determined whether the skirt light-shielding part 38 is detected or not. If YES, the processing goes to ST53. If NO, the processing returns to ST52.

In ST53, the measurement of the skirt detection time t1 is ended, and the processing goes to ST8 in FIG. 21.

In ST54 in FIG. 21, it is determined whether the skirt detection time t1 is longer than the reference time t0. If YES, the processing goes to ST55. If NO, the processing goes to ST7 in FIG. 21.

In ST55, the margin time $\alpha$ is added to the difference between the skirt detection time t1 and the reference time t0 to set the in-job raising time td, and the processing goes to ST56.

In ST56, the following processing (1) and processing (2) are executed, and the processing goes to ST57.

(1) Raising of the stack plate 11 is started.

(2) The in-job raising time td is set in the timer TM2.

In ST57, it is determined whether the in-job raising time td has elapsed or not (time-up). If YES, the processing goes to ST58. If NO, the processing returns to ST57.

In ST58, raising of the stack plate 11 is ended, and the processing goes to ST7 in FIG. 21.

Operation of Third Exemplary Embodiment

With the image forming apparatus U according to the third exemplary embodiment having the above-described configuration, ST1, ST3 to ST5, and ST41 to ST43 in the raising/lowering control processing according to the third exemplary embodiment shown in FIG. 21 are executed. In particular, the surface position of the recording sheet S is detected through the sealing skirt 36, and like the second exemplary embodiment, the stack plate 11 moves from the lowered position to the raised position. Accordingly, in the third exemplary embodiment, like the second exemplary embodiment, a positional relationship between the distal end 36*b* of the sealing skirt 36 and the actually sucked portion of the recording sheet S likely matches a predetermined positional relationship. A suction failure is likely reduced as compared with the configuration of related art.

Also, in the third exemplary embodiment, ST51 to ST53 in the raising/lowering control processing are executed. In particular, when the recording sheet S is sucked, the skirt detection time t1 from when driving of the exhaust fan HF is started to when the recording sheet S is attracted to the head body 23 and the skirt light-shielding part 38 is detected is measured. Then, if the skirt detection time t1 is longer than the reference time t0, ST54 to ST58 in the raising/lowering control processing are executed. In particular, the stack plate 11 is raised and moved to the raised position for the in-job raising time td set based on the skirt detection time t1. That is, in the third exemplary embodiment, if the distance between a topmost surface of recording sheets S on the stack plate 11 and the head body 23 of the suction head 22 is small, the recording sheet S is immediately sucked, raising of the sealing skirt 36 is started, and hence the skirt detection time t1 becomes short. In contrast, if the distance between the topmost surface of the recording sheets S on the stack plate 11 and the head body 23 of the suction head 22 is large, suction of the recording sheet S to the suction head 22 takes a time, and hence the skirt detection time t1 becomes long.

If the recording sheets S are fed and the recording sheets S on the stack plate 11 are reduced, the distance between the topmost surface of the recording sheets S on the stack plate 11 and the head body 23 of the suction head 22 becomes large, and the skirt detection time t1 becomes long. Therefore, in the third exemplary embodiment, if the skirt detection time t1 is longer than the reference time t0, it is determined that the distance between the surface position of the recording sheet S and the head body 23 is too large. The stack plate 11 is raised to be moved toward the head body 23 and moved to the raised position. Hence, a positional relationship between the head body 23 or the distal end 36*b* of the sealing skirt 36 and the actually sucked portion of the recording sheet S likely matches a predetermined positional relationship. A suction failure is reduced.

In the third exemplary embodiment, when the stack plate 11 is moved during a job, the stack plate 11 is moved if the skirt detection time t1 is longer than the reference time t0, instead of that the stack plate 11 is moved every time when the recording sheets S are fed by the predetermined number m.

Regarding recording sheets S stacked on the stack plate 11, recording sheets S of even the same kind may be curled or not curled depending on temperature and humidity. Also, the amount of curl may vary with time. Further, when a sheet with an image on one side thereof, i.e., a backing sheet is used, a winkle, a fold line, a punched hole, etc., formed on the backing sheet may cause an interval between recording sheets to be increased as compared with an interval between unused recording sheets S of the same kind.

Hence, in the configuration in which the stack plate 11 is moved to the raised position every time when recording sheets S are fed by the predetermined number m, a number m that is expected to be proper for a kind of recording sheets S in view of thickness, size, and weight is used. Thus, the positional relationship between the topmost surface of the recording sheets S on the stack plate 11 and the suction head 22 may be degraded.

In contrast, with the third exemplary embodiment, the movement control is made for the stack plate 11 to the raised position based on the actual time required for suction and raising of the recording sheet S stacked on the stack plate 11. The state of the recording sheet S stacked on the stack plate 11 is likely reflected as compared with the configuration in which the stack plate 11 is moved every time when the recording sheets S are fed by the predetermined number m. A suction failure is likely reduced.

Fourth Exemplary Embodiment

Figure 22:
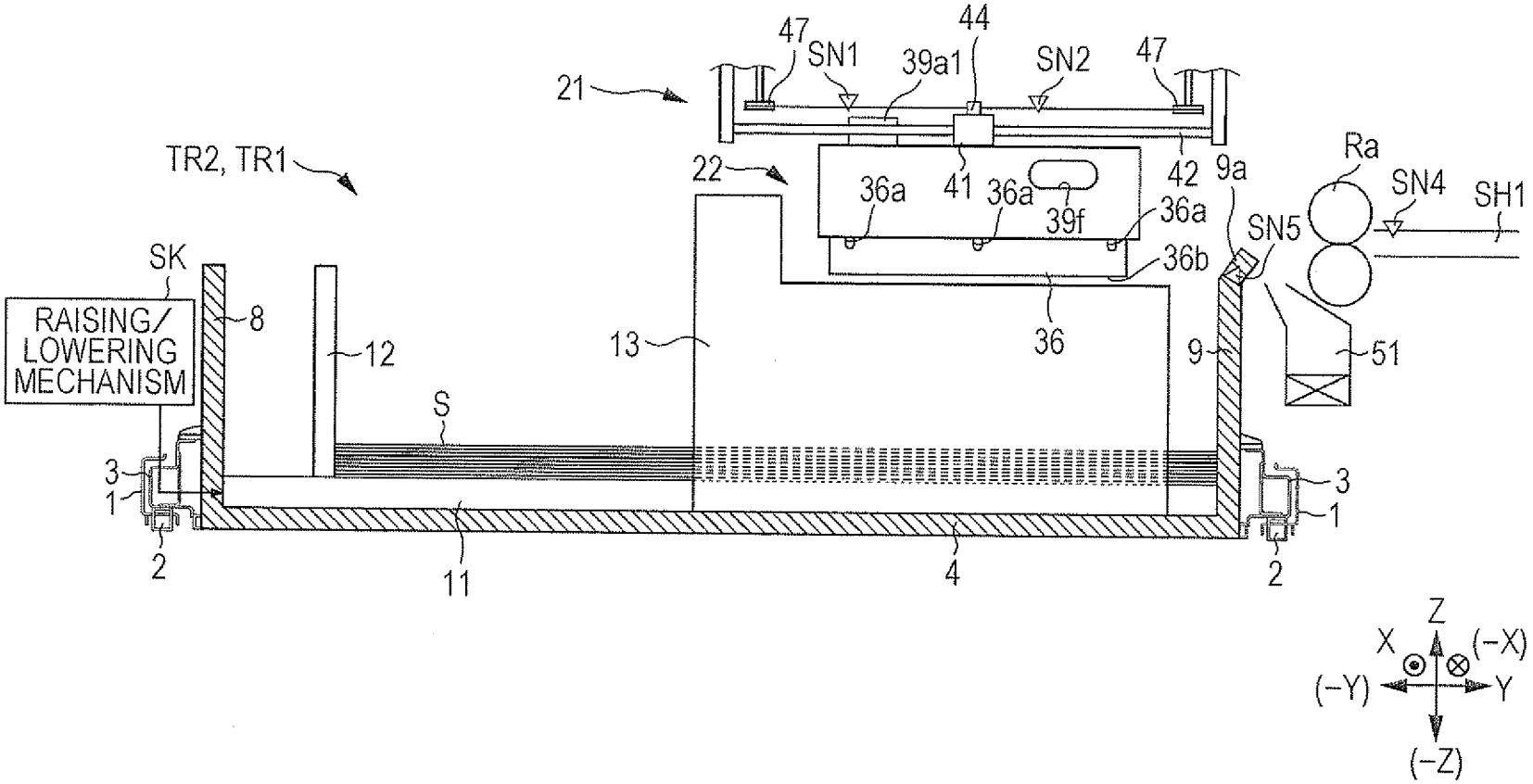
FIG. 22 is an enlarged view of a feature section of a sheet feed tray according to a fourth exemplary embodiment and corresponds to FIG. 2 of the first exemplary embodiment.

FIG. 22 is an enlarged view of a feature section of a sheet feed tray according to a fourth exemplary embodiment and corresponds to FIG. 2 of the first exemplary embodiment.

Next, the fourth exemplary embodiment of the present invention is described. In description of the fourth exemplary embodiment, like reference signs refer like components corresponding to the components of any of the first to third exemplary embodiments, and detailed description is omitted.

This exemplary embodiment differs from the third exemplary embodiment in the following points. Other points of this exemplary embodiment are similar to those of the third exemplary embodiment.

In FIG. 22, a sheet surface sensor SN5 as an example of a detecting member that detects a position of a surface of a recording sheet S is supported at an upper portion of the right wall 9 of each of the sheet feed trays TR1 and TR2.

Description of Controller According to Fourth Exemplary Embodiment

Figure 23:
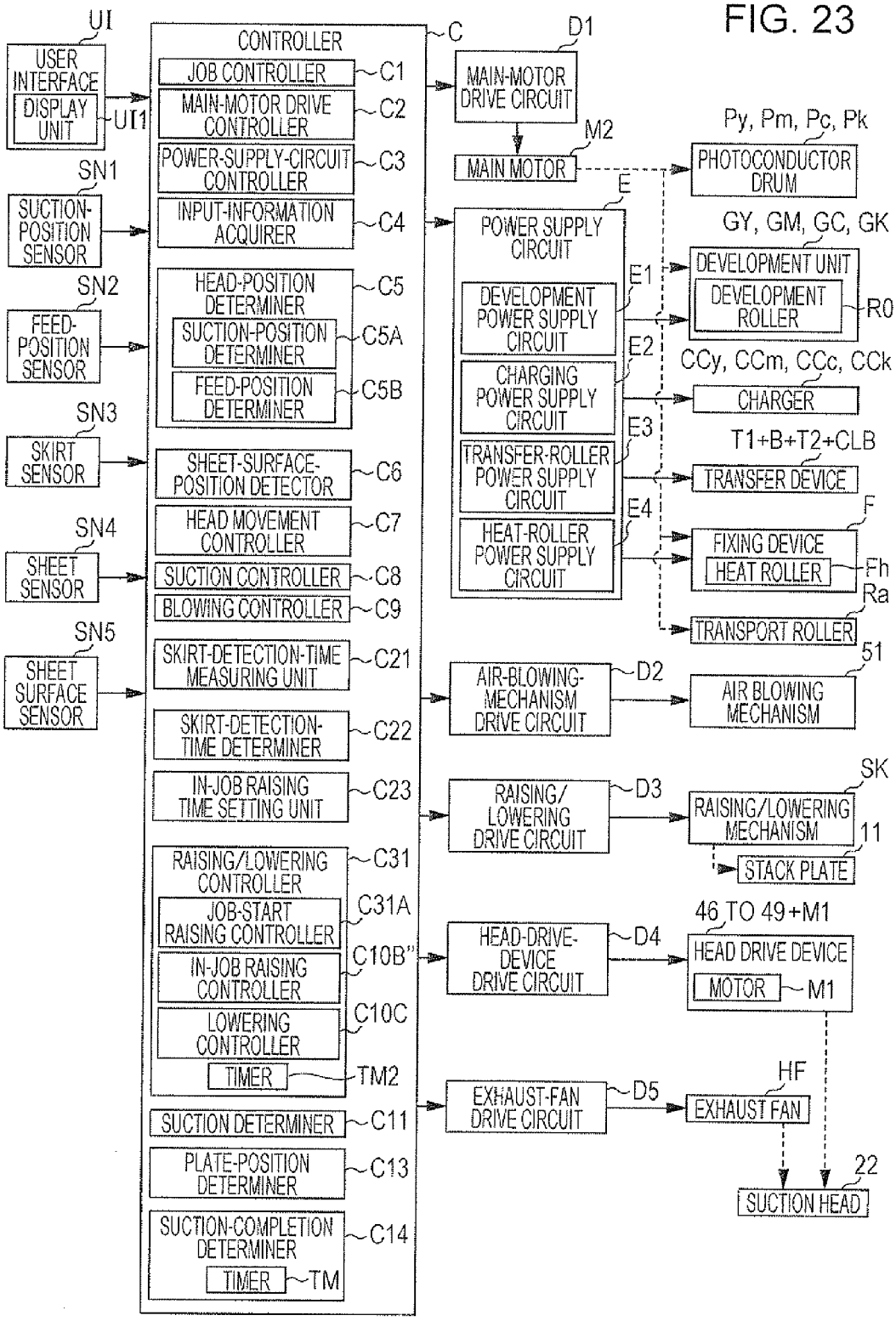
FIG. 23 is a block diagram showing functions included in a controller of an image forming apparatus according to the fourth exemplary embodiment and corresponds to FIG. 20 of the third exemplary embodiment.

FIG. 23 is a block diagram showing functions included in a controller of an image forming apparatus according to the fourth exemplary embodiment and corresponds to FIG. 20 of the third exemplary embodiment.

Signal Output Element Connected with Controller C

In FIG. 23, the controller C according to the fourth exemplary embodiment additionally includes a signal output element SN5 as follows.

Sheet Surface Sensor SN5

The sheet surface sensor SN5 detects the presence of a recording sheet S, and inputs a detection signal to the controller C. A detection position of the sheet surface sensor SN5 according to the fourth exemplary embodiment corresponds to a position of a surface of a recording sheet S on the stack plate 11 when the stack plate 11 is at the raised position. Hence, if the detection signal of the sheet surface sensor SN5 is changed from a non-present signal to a present signal, it is detected that the stack plate 11 is at the raised position.

Functions of Controller C

In FIG. 23, the controller C according to the fourth exemplary embodiment includes a raising/lowering controller C31 according to the fourth exemplary embodiment, instead of the raising/lowering controller C10" according to the third exemplary embodiment.

Raising/Lowering Controller C31

The raising/lowering controller C31 according to the fourth exemplary embodiment includes a job-start raising controller C31A according to the fourth exemplary embodiment, instead of the job-start raising/lowering controller C10A' according to the third exemplary embodiment.

Job-Start Raising Controller C31A

If a first recording sheet S is fed at start of a job, the job-start raising controller C31A according to the fourth exemplary embodiment moves the stack plate 11 to the raised position, based on a detection result of the sheet surface sensor SN5. In the fourth exemplary embodiment, when the job is started, the stack plate 11 is moved to the raised position based on a detection result of the sheet surface sensor SN5 at the right wall 9 of each of the sheet feed trays TR1 and TR2, instead of that the stack plate 11 is moved to the raised position based on a detection result of the head light-shielding part 38 detected by the skirt sensor SN3.

Description of Flowchart According to Fourth Exemplary Embodiment

Next, the flow of processing of the image forming apparatus U according to the fourth exemplary embodiment of the present invention is described with reference to a flowchart.

Figure 24:
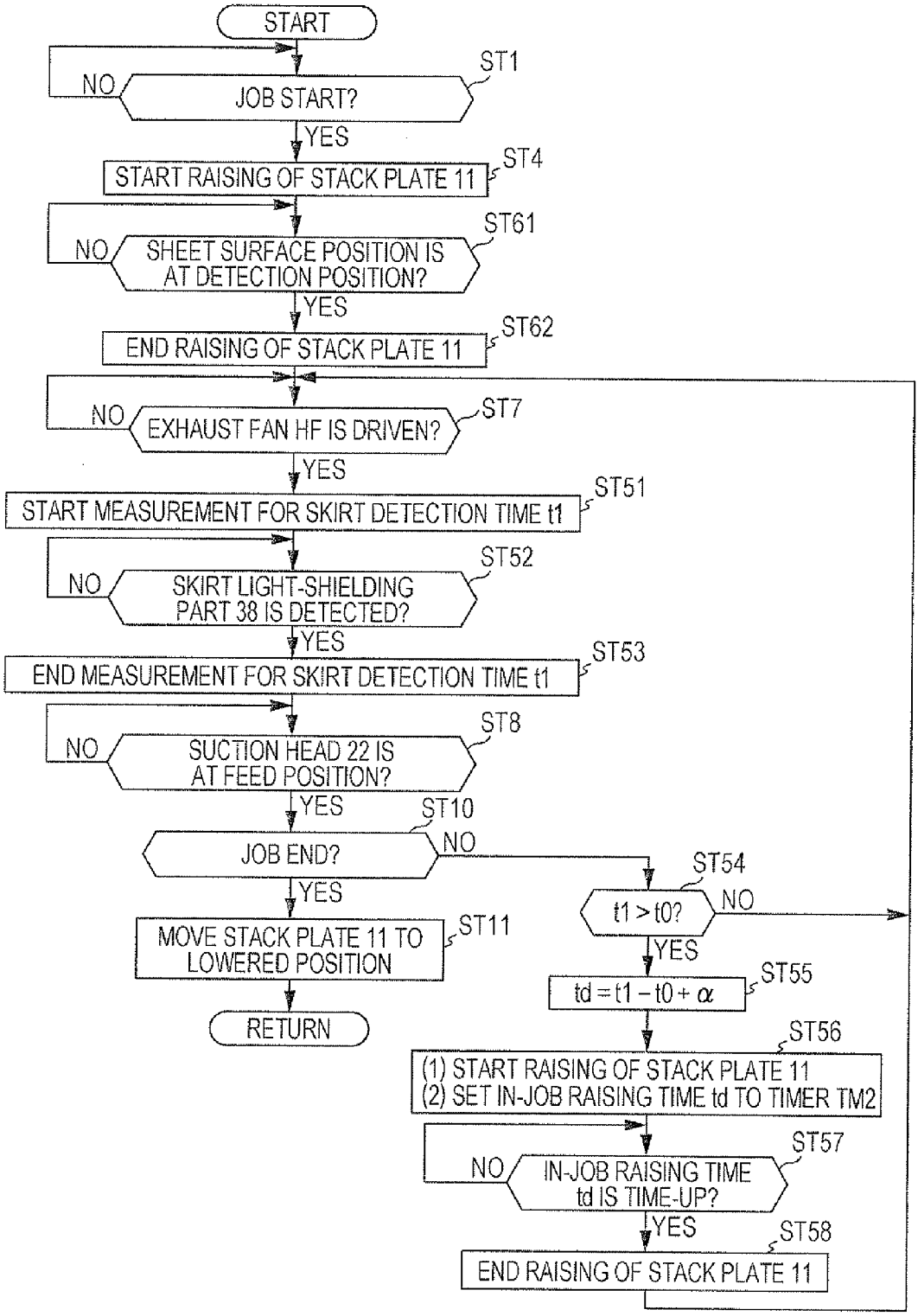
FIG. 24 is a flowchart of raising/lowering control processing according to the fourth exemplary embodiment of the preset invention and corresponds to FIG. 21 of the third exemplary embodiment.

Description of Flowchart for Raising/Lowering Control Processing According Fourth Exemplary Embodiment FIG. 24 is a flowchart of raising/lowering control processing according to the fourth exemplary embodiment of the preset invention and corresponds to FIG. 21 of the third exemplary embodiment.

In FIG. 24, in the raising/lowering control processing according to the fourth exemplary embodiment, ST3 in the raising/lowering control processing according to the third exemplary embodiment is omitted. Also, in the raising/lowering control processing according to the fourth exemplary embodiment, ST61 and ST62 are executed instead of ST5, and ST41 to ST43 in the raising/lowering control processing according to the third exemplary embodiment. The processing other than ST61 and ST62 are similar to that of the third exemplary embodiment. Detailed description of the processing similar to that of the third exemplary embodiment is omitted.

In ST61 in FIG. 24, it is determined whether the sheet surface sensor SN5 detects a recording sheet S or not. If YES, the processing goes to ST62. If NO, the processing returns to ST61.

In ST62, raising of the stack plate 11 is ended, and the processing goes to ST7 in FIG. 24.

Operation of Fourth Exemplary Embodiment

With the fourth exemplary embodiment having the above-described configuration, when a job is started, ST4, ST61, and ST62 in the raising/lowering control processing according to the fourth exemplary embodiment shown in FIG. 24 are executed. In particular, the stack plate 11 is raised and moved to the raised position until the sheet surface sensor SN5 detects the recording sheet S on the stack plate 11. Then, the recording sheet S is sucked to the suction head 22 from the stack plate 11 moved to the raised position. At this time, ST51 to ST53, ST54 to ST58, etc., in the raising/lowering control processing are executed. In particular, the skirt detection time t1 is measured like the third exemplary embodiment, and if the stack plate 11 is moved to the raised position during the job, the stack plate 11 is moved to the raised position based on the skirt detection time t1.

Hence, movement of the stack plate 11 is controlled based on a detection result of the skirt light-shielding part 38 detected by the skirt sensor SN3 at a timing except when a job is started in the fourth exemplary embodiment. A positional relationship between the distal end 36*b* of the sealing skirt 36 and the actually sucked portion of the recording sheet S likely matches a predetermined positional relationship as compared with the configuration of related art. Accordingly, a suction failure is reduced.

In the third exemplary embodiment, when the stack plate 11 is raised, the sealing skirt 36 is pushed upward, and the skirt sensor SN3 detects the skirt light-shielding part 38, the stack plate 11 is lowered and moved to the raised position. In contrast, in the fourth exemplary embodiment, the stack plate 11 is merely moved to the raised position based on a detection result of the sheet surface sensor SN5. The configuration of lowering the stack plate 11 and lowering the sealing skirt 36 is omitted.

That is, with the configuration based on the skirt detection time t1 according to any of the third and fourth exemplary embodiments, the skirt light-shielding part 38 has to be moved to a position below the detection position of the skirt sensor SN3 before the recording sheet S is sucked to the suction head 22. In the fourth exemplary embodiment, an entire processing time is likely reduced, and a suction failure in an entire job is likely reduced, as compared with the configuration according to the third exemplary embodiment using only the skirt sensor SN3 required to lower the stack plate 11.

Modifications

The exemplary embodiments of the present invention are described above; however, the present invention is not limited to the exemplary embodiments, and may be modified within the scope of the present invention described in the claims. Modifications (H01) to (H09) of the invention are exemplarily described below.

(H01) In any of the above-described exemplary embodiments, a copier is used as an example of the image forming apparatus U. However, it is not limited thereto. The image forming apparatus may be a multifunction apparatus including at least one of functions of facsimile and printing, in addition to the function of copying. Also, the image forming apparatus is not limited to an electrophotographic image forming apparatus. The image forming apparatus may be an image forming apparatus of any image forming system, such as a printer of an inkjet recording system, a thermal head system, and a lithography system. Also, the image forming apparatus is not limited to an image forming apparatus with multi-color development. The image forming apparatus may be an image forming apparatus with a single color, i.e., a monochromatic image forming apparatus.

(H02) In any of the above-described exemplary embodiments, the front, rear, left, and right walls of the sealing skirt 36 move together. However, it is not limited thereto. For example, a front wall, a rear wall, a left wall, and a right wall may be provided and may be supported so as to be independently movable. Further, each of the front, rear, left, and right walls may be formed of plural plates. For example, plural strip-like plates may be independently movably supported as individual members, and may move along a surface profile of a bent sheet S.

(H03) In any of the above-described exemplary embodiments, an example of the surrounding member may be the sealing skirt 36 movably supported by the pins 34. However, it is not limited thereto. For example, the pins 34 may be omitted, and a surrounding member may be formed of a bellows-like member. An upper end of the bellows-like surrounding member is supported at the head body 23, and the bellows-like surrounding member is expanded and contracted, so that a lower end of the bellows-like surrounding member moves toward and away from the stack plate 11. In this case, the skirt light-shielding part is not supported at the upper end of the bellows-like surrounding member, and is required to move in association with movement of the lower end which is the distal end of the surrounding member, for example, such that the skirt light-shielding part is connected with the lower end of the bellows-like surrounding member and hence is movably supported to the head body 23.

(H04) In any of the above-described embodiments, the skirt light-shielding part 38 is supported at the right wall of the sealing skirt 36. However, it is not limited thereto. As long as the skirt light-shielding part 38 moves in association with the movement of the sealing skirt 36, the skirt light-shielding part 38 may be supported at any portion of the sealing skirt 36. Also, in any of the exemplary embodiments, only the single skirt light-shielding part 38 is provided. However, plural skirt light-shielding parts 38 may be provided, and the sheet surface position may be detected based on an average value of detection results of the plural skirt light-shielding parts 38, or based on a detection result of the skirt light-shielding part 38 that is detected at a latest timing.

(H05) In any of the first to third exemplary embodiments, the in-job raising controllers C10B, C10B' and C10B" have different configurations depending on the first to third exemplary embodiments. However, the configuration of each exemplary embodiment is not limited thereto. For example, the first exemplary embodiment may use the in-job raising controller C10B' according to the second exemplary embodiment instead of the in-job raising controller C10B according to the first exemplary embodiment. When the stack plate 11 is raised during a job, the stack plate 11 may be raised for the predetermined time tb regardless of the detection result of the skirt sensor SN3. That is, in any of the first to third exemplary embodiments, any of the in-job raising controllers C10B to C10B" of any of the first to third exemplary embodiments may be used.

(H06) In any of the third and fourth exemplary embodiments, when the stack plate 11 is raised, the in-job raising controller C10B" may raise the stack plate 11 for the in-job raising time td calculated and set based on the skirt detection time t1. However, it is not limited thereto. The stack plate 11 may be raised for a predetermined in-job raising time. In this case, determination only for a timing at which the stack plate 11 is raised is based on the skirt detection time t1.

(H07) In any of the above-described exemplary embodiments, the skirt sensor SN3 may be supported at the head body 23. However, the skirt sensor SN3 may be supported at a portion other than the head body 23 as long as the skirt sensor SN3 is in a stationary state relative to the head body 23 in the directions in which the sealing skirt 36 moves toward and away from the stack plate 11. For example, the skirt sensor may be supported at the body of the sheet feed device U2, and the skirt light-shielding part movably supported at the suction head 22 at the suction position may be detected.

(H08) In the first exemplary embodiment, the stack plate 11 is raised and moved to the raised position until the skirt sensor SN3 detects the skirt light-shielding part 38. However, the configuration that moves the stack plate 11 to the raised position is not limited thereto. For example, when a job is started, the stack plate 11 may be raised and moved to the raised position only for a predetermined time after the skirt sensor SN3 detects the skirt light-shielding part 38. During the job, when the sealing skirt 36 is lowered when the recording sheet S is fed and if the skirt sensor SN3 no longer detects the skirt light-shielding part 38, the stack plate 11 may be raised for a predetermined time and moved to the raised position. In this case, the state of the recording sheet S stacked on the stack plate 11 may be likely reflected as compared with a case in which the stack plate 11 is raised and moved to the raised position every time when recording sheets S are fed by the predetermined number m. A suction failure is likely reduced.

(H09) In the fourth exemplary embodiment, when a job is started, the stack plate 11 is moved to the raised position based on the detection result of the sheet surface sensor SN5, and the skirt detection time t1 when the recording sheet S is sucked is measured based on the detection result of the skirt sensor SN3. However, it is not limited thereto. For example, a second skirt sensor that detects the skirt light-shielding part 38 may be provided below the skirt sensor SN3 instead of the sheet surface sensor SN5. When a job is started, the stack plate 11 is moved to the raised position based on a detection result of the lower second skirt sensor, and the skirt detection time t1 may be measured based on a detection result of the upper skirt sensor SN3.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A medium feed device comprising:

a stack member with a medium stacked thereon;

a suction member including a suction-member body arranged to face the medium on the stack member, and a surrounding member that surrounds a suction port formed at the suction-member body, extends from the suction-member body toward the medium on the stack member, and is supported movably in directions toward and away from the stack member, wherein the suction member has a space formed inside the surrounding member and surrounded by the surrounding member, a suction device being connected with the suction port, the suction device sucking gas from the space through the suction port and sucking the medium on the stack member, and wherein the surrounding member moves in the direction away from the stack member together with the medium by the suction of the suction device if the medium contacts a distal end of the surrounding member;

a stack-member moving mechanism that moves the stack member between a sucked position at which the stack member moves toward the suction member and the medium on the stack member is sucked to the suction member and a retracted position at which the stack member is retracted in a direction away from the suction member with respect to the sucked position;

a suction-member moving mechanism that moves the suction member between a suction position at which the suction member faces the medium on the stack member moved to the sucked position and is able to suck the medium and a feed position located downstream in a medium transport direction with respect to the suction position;

a transport member that transports the medium sucked to the suction member moved to the feed position, to a downstream side;

a detected part that is supported at the surrounding member and moves in association with movement of the distal end of the surrounding member that movingly extends from the suction member body towards the medium on the stack member; and a detecting part that is supported in a stationary state relative to the suction-member body in the directions in which the surrounding member moves toward and away from the stack member and detects the detected part;

a detector that detects a medium surface position, which is a position of a surface of the medium that contacts the distal end of the surrounding member, with respect to the suction-member body, based on a detection result of the detected part detected by the detecting part if the stack member moves to the sucked position and when the stack member moves in the direction in which the distal end of the surrounding member moves toward the suction-member body from a state in which the medium on the stack member contacts the distal end of the surrounding member, wherein the stack-member moving mechanism moves the stack member to the sucked position if the stack member moves to the sucked position and when the stack member moves in the direction in which the distal end of the surrounding member moves toward the suction-member body from the state in which the medium on the stack member contacts the distal end of the surrounding member, the stack-member moving mechanism moving the stack member to the sucked position based on the medium surface position detected by the detector.

2. The medium feed device according to claim 1, wherein the stack-member moving mechanism moves the stack member toward the suction-member body and then to the sucked position if a time from when the suction device starts a suction operation to when the detecting part detects the detected part is longer than a predetermined reference time.

3. An image forming apparatus comprising:

the medium feed device according to claim 1; and an image recording section that records an image on the medium fed from the medium feed device.

* * * * *